US008337300B2

(12) United States Patent
Bowers et al.

(10) Patent No.: US 8,337,300 B2
(45) Date of Patent: Dec. 25, 2012

(54) CONTROLLING AND REWARDING WAGERING GAME SKILL

(75) Inventors: Travis L. Bowers, Henderson, NV (US); Joel R. Jaffe, Glenview, IL (US); John F. LaSalvia, Las Vegas, NV (US); Michael W. Mastropietro, Chicago, IL (US); Scott H. Schulhof, Chicago, IL (US); Richard T. Schwartz, Chicago, IL (US); Jorge L. Shimabukuro, Las Vegas, NV (US); Bruce E. Urban, Lisle, IL (US); Michael C. Ward, Las Vegas, NV (US)

(73) Assignee: WMS Gaming. Inc., Waukegan, IL (US)

( * ) Notice: Subject to any disclaimer, the term of this patent is extended or adjusted under 35 U.S.C. 154(b) by 55 days.

(21) Appl. No.: 13/126,503

(22) PCT Filed: Oct. 30, 2009

(86) PCT No.: PCT/US2009/062754

§ 371 (c)(1),
(2), (4) Date: Apr. 28, 2011

(87) PCT Pub. No.: WO2010/051442

PCT Pub. Date: May 6, 2010

(65) Prior Publication Data

US 2011/0212766 A1 Sep. 1, 2011

Related U.S. Application Data

(60) Provisional application No. 61/110,381, filed on Oct. 31, 2008.

(51) Int. Cl.
*A63F 9/24* (2006.01)

(52) U.S. Cl. ..... 463/25

(58) Field of Classification Search ..... 463/16–20, 463/25, 29

See application file for complete search history.

(56) References Cited

U.S. PATENT DOCUMENTS 6,692,005 B2 2/2004 Vancura et al.

(Continued)

FOREIGN PATENT DOCUMENTS

JP 2000271312 10/2000
WO WO2010051442 5/2010

OTHER PUBLICATIONS

"PCT Application No. PCT/US09/62754 International Preliminary Report on Patentability", Oct. 4, 2010, 9 pages.

(Continued)

*Primary Examiner* — Omkar Deodhar

(74) *Attorney, Agent, or Firm* — DeLizion Gilliam, PLLC

(57) ABSTRACT

A wagering game system and its operations are described herein. In embodiments, the operations can include presenting a skill-based wagering game on a wagering game machine. The skill-based wagering game can have a limited winnable award amount for the skill-based wagering game. The operations can also include tracking skilled game goals that a player accomplishes during the skill-based wagering game and awarding the player from the limited winnable award amount. The operations can also include determining a surplus amount that was not earned from the limited winnable award amount, and awarding some, or all, of the surplus amount during subsequent activity. In some embodiments, the operations can also include allocating the surplus amount to wagering game pools, distributing the surplus amount as tokens based on triggered activities, and presenting game modifiers that enable players to enhance performance in a skill-based game.

23 Claims, 12 Drawing Sheets

U.S. PATENT DOCUMENTS

| | | | |
|---|---|---|---|
| 7,470,186 | B2 | 12/2008 | Cannon |
| 7,470,197 | B2 | 12/2008 | Massey et al. |
| 2006/0035706 | A1 | 2/2006 | Thomas et al. |
| 2006/0258434 | A1 | 11/2006 | Jaffe et al. |
| 2008/0070658 | A1 | 3/2008 | Labgold et al. |
| 2008/0076514 | A1 | 3/2008 | Baerlocher et al. |
| 2008/0242392 | A1 | 10/2008 | Inamura |
| 2008/0254867 | A1 | 10/2008 | Fujimoto et al. |
| 2008/0254893 | A1 | 10/2008 | Patel et al. |

OTHER PUBLICATIONS

"PCT Application No. PCT/US09/62754 International Search Report", Dec. 10, 2009, 9 pages.

"Technical Standards for Gaming Devices and On-Line Slot Systems", *Nevada Gaming Control Board: Proposed Technical Standards for Physical Skill Based Gaming* May 21, 2007, 5 pages.

BET365, "Games—Home", bet365 http://games.bet365.com/?ggid=10 (obtained Apr. 15, 2008) 2008, 2 pages.

CONTROLLING AND REWARDING WAGERING GAME SKILL

RELATED APPLICATIONS

This application claims the priority benefit of U.S. Provisional Application Ser. No. 61/110,381 filed Oct. 31, 2008.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2009, WMS Gaming, Inc.

TECHNICAL FIELD

Embodiments of the inventive subject matter relate generally to wagering game systems and networks that, more particularly, control and reward wagering game skill.

BACKGROUND

Wagering game machines, such as slot machines, video poker machines and the like, have been a cornerstone of the gaming industry for several years. Wagering game operators (e.g., casinos), that provide the wagering game machines, must abide by many jurisdictional requirements. For instance, wagering game machines may be required by regulations, depending on the jurisdiction, to meet certain payout requirements, meaning that on average (e.g., over a period of time, over a set number of games, over a set number of spins, etc.), a wagering game machine should pay out certain amounts of "coin-in" (i.e., money that is put into the wagering game machine as a wager) back to wagering game players that use the wagering game machine. For example, in Nevada, some wagering game machines are required on average to payout out at least 75% of coin-in back to wagering game players. This allows for no more than a 25% profit margin for the casino operating the wagering game machine. Many casinos, however, will payout even more, such as between 82-98% of coin-in to entice players to play those machines over other machines at other casinos. Casinos, therefore, are faced with the challenge of providing wagering games that meet regulatory requirements but that also can provide a predictable amount of income.

SUMMARY

Some embodiments include a method comprising allocating a winnable award used exclusively for payouts on a wagering game network, wherein any portion of the winnable award can be won during at least some portion of a skill-based wagering game; presenting the skill-based wagering game; providing one or more skilled game goals for a player account to accomplish during the at least some portion of the skill-based wagering game; determining a goal completion amount, of the one or more skilled game goals, that the player account accomplishes; awarding at least some portion of the winnable award amount to the player account based on the goal completion amount, the at least some portion of the winnable award amount totaling a total earned award amount; determining a surplus amount that was not won by the player from the winnable award amount, the surplus amount representing the total earned award amount subtracted from the winnable award amount; and awarding the surplus amount during subsequent activity on the wagering game network.

In some embodiments, the method further comprises receiving control signals from one or more control devices on a wagering game machine; processing control instructions in direct response to the control signals, causing the one or more control elements to immediately interact with game play elements to effectuate one or more physically skilled game goals; and determining that the player account accomplishes the goal completion amount via the skillful manipulation of the one or more control devices.

In some embodiments, awarding the surplus amount comprises distributing the surplus amount over a bank of wagering game machines.

In some embodiments, awarding the surplus amount comprises: determining that a payout percentage of a wagering game machine is below a theoretical payout percentage; and awarding the surplus amount to the wagering game machine to increase the payout percentage to comply with the theoretical payout percentage.

In some embodiments, awarding the surplus amount comprises randomly presenting, during the subsequent activity, one or more of a mystery bonus, a lump sum award, a partial pay award, and an additional feature bonus.

In some embodiments, determining the goal completion amount and awarding the at least some portion of the winnable award amount comprises determining a skill level for the player account; and adapting a game difficulty based on the skill level.

In some embodiments, awarding the surplus amount comprises allocating the surplus amount to a wagering game pool; determining that a payout percentage of a wagering game machine is below a theoretical payout percentage; and awarding at least some portion of the pool to a player account that is using the wagering game machine.

Some embodiments include one or more machine-readable media having instructions stored thereon, which when executed by a set of one or more processors causes the set of one or more processors to perform operations comprises presenting a skill-based wagering game on a wagering game machine, the skill-based wagering game having a limited winnable award amount, wherein at least some portion of the limited winnable amount can be won during at least some portion of the skill-based wagering game for skillful performance during the skill-based wagering game; determining a surplus amount that was not won by a player account from the limited winnable award amount in the skill-based wagering game; processing subsequent activity on the wagering game machine; determining a trigger activity that occurs during the subsequent activity; and providing at least some portion of the surplus amount based on the trigger activity.

In some embodiments, the trigger activity is based on one or more of skillful activities performed by the player account and random events during the subsequent activity.

In some embodiments, said operations of determining the trigger activity and presenting the at least some portion of the surplus amount include operations further comprising: determining one or more trigger settings that describe the trigger activity and one or more trigger payout values associated with the trigger activity; determining that the trigger activity occurs during the subsequent activity; and paying out the at least some portion of the surplus amount, wherein the at least some portion of the surplus amount corresponds in value to the one or more trigger payout values.

In some embodiments, said operations further comprise generating one or more tokens with values equivalent to the surplus amount; persisting at least some of the one or more tokens; and using the one or more tokens to pay out the at least some portion of the surplus amount.

Some embodiments include a system comprising a wagering game machine that comprises an activity tracking unit configured to track accomplishments of skill-based goals in a skill-based networked wagering game. The skill-based networked wagering game having a limited award amount used exclusively for payouts, wherein at least some portion of the limited award amount can be awarded during the skill-based networked wagering game, and award monetary amounts, from the limited award amount, based on skill-based goals achieved by a player account during the skill-based networked wagering game. The system can also include a wagering game server comprising a winnable award tracking unit configured to determine an unearned portion of the limited award amount for the skill-based networked wagering game, and to distribute the unearned portion of the limited award amount to one or more of the wagering game machine and additional wagering game machines that are below a theoretical payout percentage.

In some embodiments, the wagering game machine further comprises a token controller configured to generate, display, and award one or more persisted tokens on the wagering game machine, wherein the one or more persisted tokens represent the unearned portion of the limited award amount as graphical symbols.

In some embodiments, the skill-based networked wagering game is available on a network where one or more of the player accounts can participate in the skill-based networked wagering game via a network connection.

In some embodiments, the activity tracking unit is configured to determine a completion time by a player account to complete one or more of the skill-based goals in the skill-based networked wagering game, and to adjust at least some portion of a completion score based on the completion time.

In some embodiments, the system further comprises a network game server including a networked game controller configured to receive a request from the wagering game machine and one or more client devices to compete in the skill-based networked wagering game, and to provide networked wagering game content to the wagering game machine and one or more client devices. The system can further include a control configuration unit configured to detect a personal player control device attached to one or more of the wagering game machine and the one or more client devices, to determine compatibility with the networked wagering game content, and to provide game control settings.

In some embodiments, the system further comprises an account server including an account controller configured to control information for the player account, an account store configured to store information for the player account, and a player skill tracker configured to track one or more of skill points and game modifiers received during the skill-based networked wagering game.

Some embodiments include an apparatus comprising a wagering game module configured to present a skill-based wagering game on a wagering game machine, where the skill-based wagering game having a limited winnable award amount allocated from one or more known award sources that can be won during at least some portion of the skill-based wagering game. The wagering game module can be further configured to determine a surplus amount that was not won by a player account from the limited winnable award amount in the skill-based wagering game, to generate one or more tokens with values equivalent to the surplus amount, to persist at least some of the one or more tokens, and to use the one or more tokens to pay out some portion of the surplus amount.

In some embodiments, the wagering game module is further configured to assign at least some of the one or more tokens to one or more of the wagering game machine, additional wagering game machines, wagering game pools, tournament prize pools, and awards in networked wagering games.

In some embodiments, the wagering game module is further configured to pay out the one or more tokens according to triggered activities.

In some embodiments, an apparatus comprises means for presenting a first wagering game on a wagering game machine; means for tracking wagering game activity during the first wagering game; means for awarding one or more game modifiers, based on the wagering game activity, the one or more game modifiers configured to enhance performance during a second wagering game, the second wagering game configured to respond to a wagering game player's skillful manipulation of one or more controllable wagering game elements, and the second wagering game having a winnable award amount that can be won during at least some portion of the second wagering game; and means for activating the one or more game modifiers during the second wagering game to improve performance for the second wagering game.

In some embodiments, the means for tracking the wagering game activity comprises: means for determining a skill level for the wagering game player; and means for awarding the one or more game modifiers based on the skill level.

In some embodiments, the means for determining the skill level comprises analyzing one or more of game results, strategy weaknesses, patterns of successful manipulation of the one or more controllable wagering game elements, and completion time.

In some embodiments, the apparatus further comprises means for presenting a selection interface for a player account to select the game modifier.

In some embodiments, the apparatus further comprises means for awarding one or more skill points based on activities performed during any one or more of the first wagering game and the second wagering game.

In some embodiments, the apparatus further comprises means for redeeming the one or more skill points.

BRIEF DESCRIPTION OF THE DRAWING(S)

Embodiments are illustrated in the Figures of the accompanying drawings in which.

DESCRIPTION OF ILLUSTRATIVE EMBODIMENTS

This description of the embodiments is divided into six sections. The first section provides an introduction to embodiments. The second section describes example operating environments while the third section describes example operations performed by some embodiments. The fourth section describes additional example embodiments while the fifth section describes additional example operating environments. The sixth section presents some general comments.

Introduction

This section provides an introduction to some embodiments.

Figure 1:
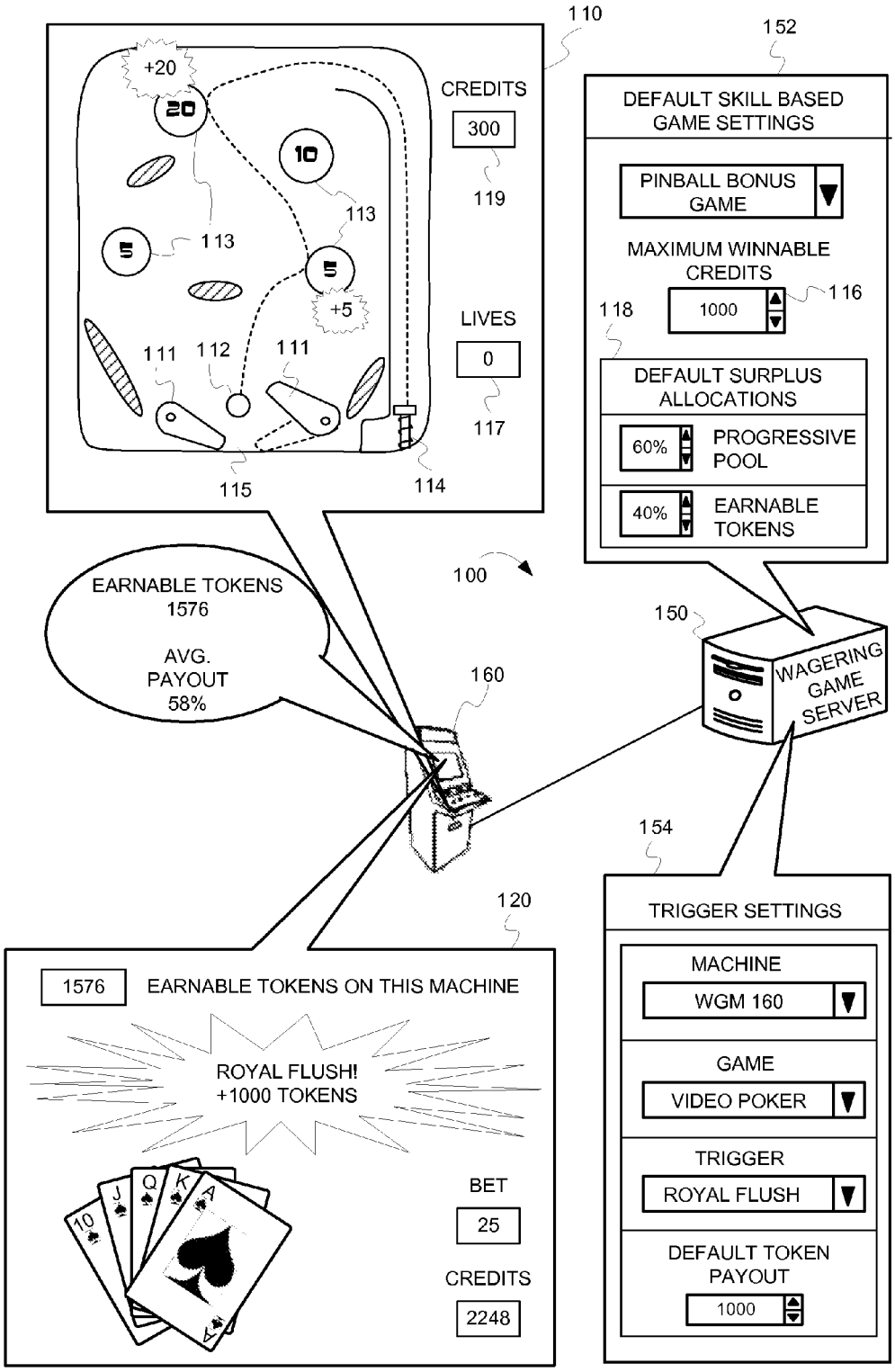
FIG. 1 is an illustration of controlling skill-based wagering games, according to some embodiments.

With small profit margins on their wagering game machines, as indicated previously, casinos have often avoided using wagering game machines that allow the game outcome to be affected by the skills of a wagering game player. The concept of using skill with wagering games implies that a player can win continuously, without limits, thus causing a wagering game machine's payout to increase without limit (e.g., a skilled player may consistently win more than 100% of the money that the player spent on the machine, thus increasing the machine's payout). Consequently, after the skilled player were to finish playing with the wagering game machine, and an unskilled were to begin playing with the same wagering game machine, the machine would have to produce an extra amount of losses to reduce the actual payout percentage on the machine, thus allowing the casino to recoup the winnings that the skilled player won. As a result, unskilled players would hardly ever win and would be discouraged from playing the wagering game machine. Embodiments of the inventive subject matter, however, provide ways for wagering game machines to incorporate a player's skill in a wagering game outcome and also to provide a consistent payout percentage, while still providing ways for unskilled players to win. FIG. 1 shows an example of providing wagering game machines that utilize limited award amounts from known, or allocated, sources that a casino has allocated for winnings in a skill-based wagering game, thus allowing skilled players to earn amounts from the allocated sources during those skill-based games, up to the amounts included in the allocated sources, or up to some pre-determined amount from the allocated sources (e.g., a pre-determined limited amount from the allocated sources, a pre-determined percentage from the allocated sources, a combination of a fixed amount from one source plus a percentage from another, etc.). Any award amounts that are not won from the allocated sources can continue to remain in the allocated sources, and/or be transferred to other payout forms described below (e.g., a holding account, tokens, etc.) which wagering game machine(s) eventually award to players using the wagering game machine during subsequent wagering game activities (e.g., as random payouts, as bonus awards, etc.).

FIG. 1 is a conceptual diagram that illustrates an example of controlling skill-based wagering games, according to some embodiments. In FIG. 1, a wagering game system ("system") 100 includes a wagering game machine 160 and a wagering game server 150. The wagering game machine 160 presents a skill-based wagering game (e.g., a skill-based pinball bonus game 110) that provides a limited winnable award amount ("winnable award amount") from a known, or allocated, source. For example, the system 100 can allocate a limited, pre-determined amount of winnable game credits into a holding account that the system 100 reserves as a payout. In other words, the system 100 uses the amount that was set aside exclusively to award as payouts either during the player's skillful game play or during subsequent activity on the system 100. If the player plays with optimal skill, the player can win the entire winnable award amount during the skill-based wagering game. If not, the system 100 will still payout the remainder of the winnable reward amount because it has already been set it aside as a payout award. However, the system 100 can decide when, where, and to whom it will award the remainder (e.g., to the same player during subsequent play, to other players on the system 100, etc.). The winnable award amount can be a fixed value stored on the system 100 (e.g., stored in an account on the wagering game machine 160, stored in an account on the wagering game server 150, etc.). The winnable award amount can also be provided from other sources that are not fixed in value, such as from a progressive pool, which may be increasing or decreasing in value as the skill-based wagering game is being played. Nevertheless, whether the source is a fixed value, a non-fixed value, or a combination of both, the system 100 accesses the allocated source and presents awards during the skill-based wagering game only from the limited award amounts within the allocated sources. The system 100, therefore, sets aside the winnable award amount of the allocated sources and uses those winnable award amounts exclusively for guaranteed payouts, at some point in time, whether to the player during the skill-based game, to the player at other times (e.g., as random awards), to other players at other times, etc. Herein, "winnable award amounts" may be referred to as "allocated", "pre-arranged", or "limited" award amounts to emphasize that those winnable award amounts have been allocated as limited, pre-arranged payouts used to (1) award skillful activity performed in skill-based wagering games, and, (2) if not won during the skill-based wagering game, placed in surplus accounts and used later as pay outs for various reasons (e.g., skillful activities, random payouts, mystery awards, etc.). "Skill-based wagering games", referred to herein, may include any computerized, or electronic, game presented during a wagering game session on a wagering game machine (and/or other devices capable of presenting computerized wagering games such as a personal computer) where any portion of the game is configured such that a player can utilize an element of skill to win an award. A "skill-based wagering game" may include, but not be limited to, the following: (1) games that accept wagers and generate payouts based on wagers (e.g., "base" games), (2) games that are an extension to a base game, limited in duration, that may not require wagers to payout awards (e.g., bonus games), (3) networked games (e.g., community games, competition games, etc.), and (4) group games that are computerized (e.g., table games, bingo, etc.). The "winnable award amount" can be confined to any portion of the skill-based wagering game that responds to a player's skill with a potential payout based on the player's performance.

Figure 4:
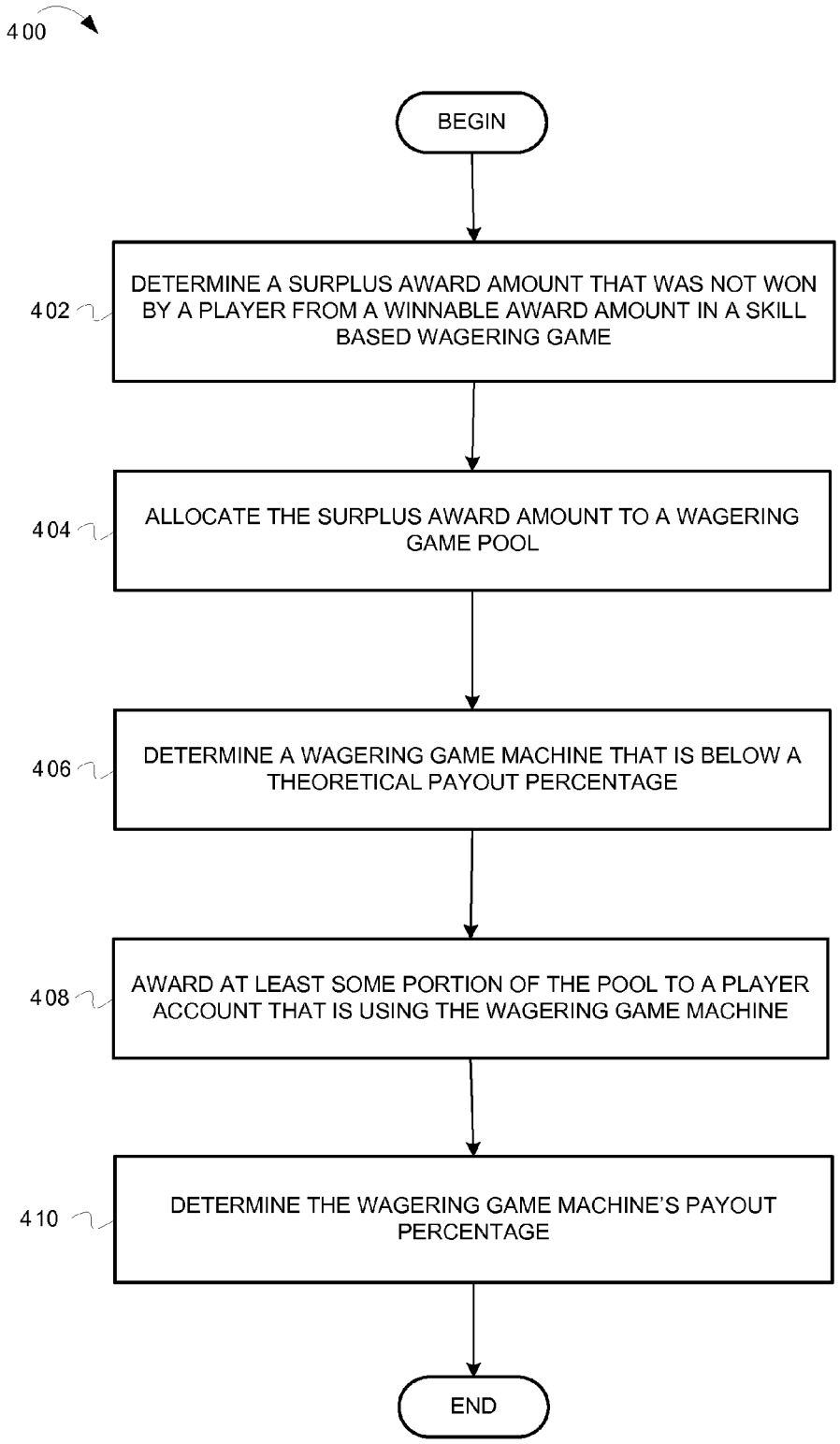
FIG. 4 is a flow diagram 400 illustrating controlling surplus amounts from skill-based wagering games using wagering game pools, according to some embodiments.
Figure 5:
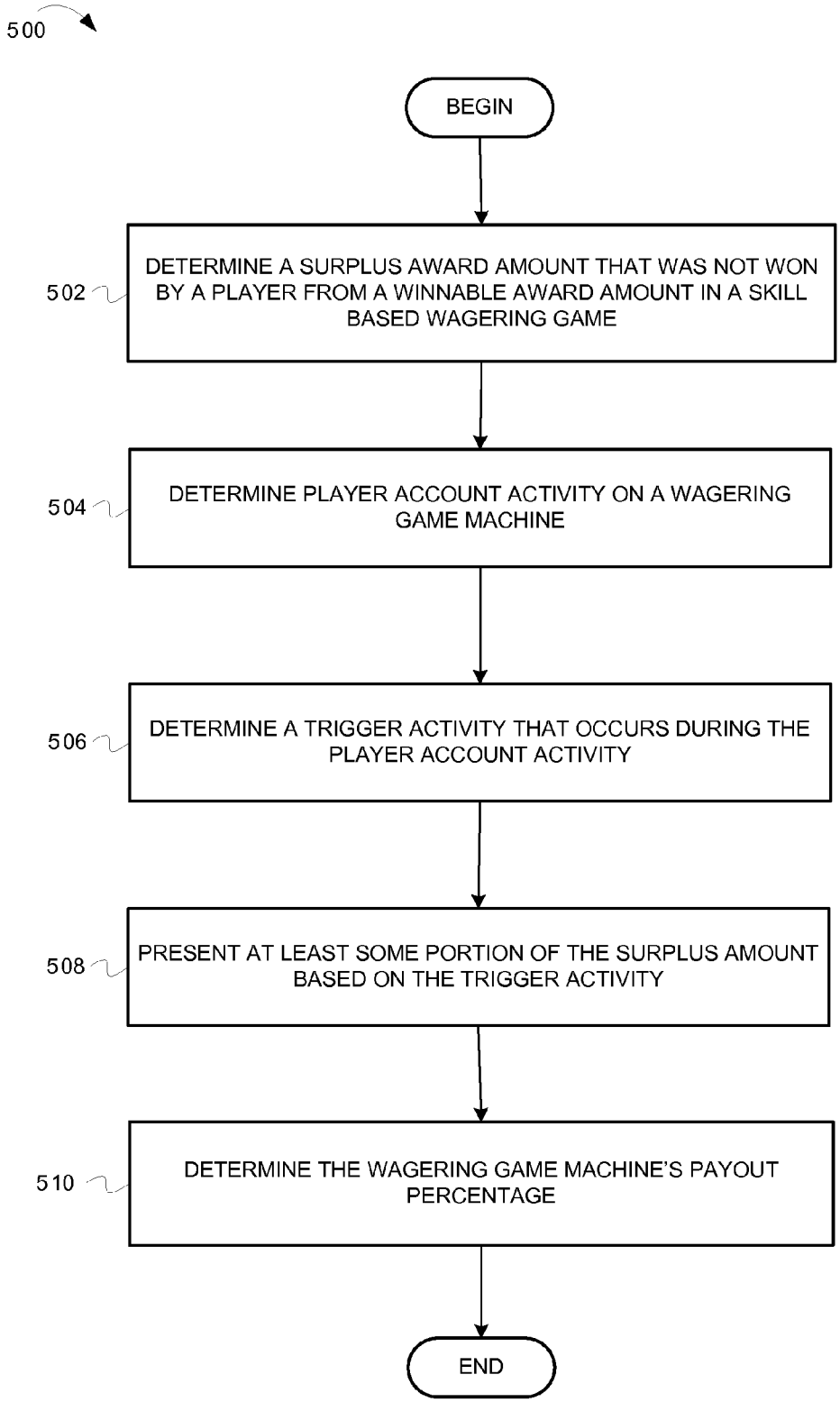
FIG. 5 is a flow diagram 500 illustrating controlling surplus amounts from skill-based wagering games using triggers, according to some embodiments.
Figure 6:
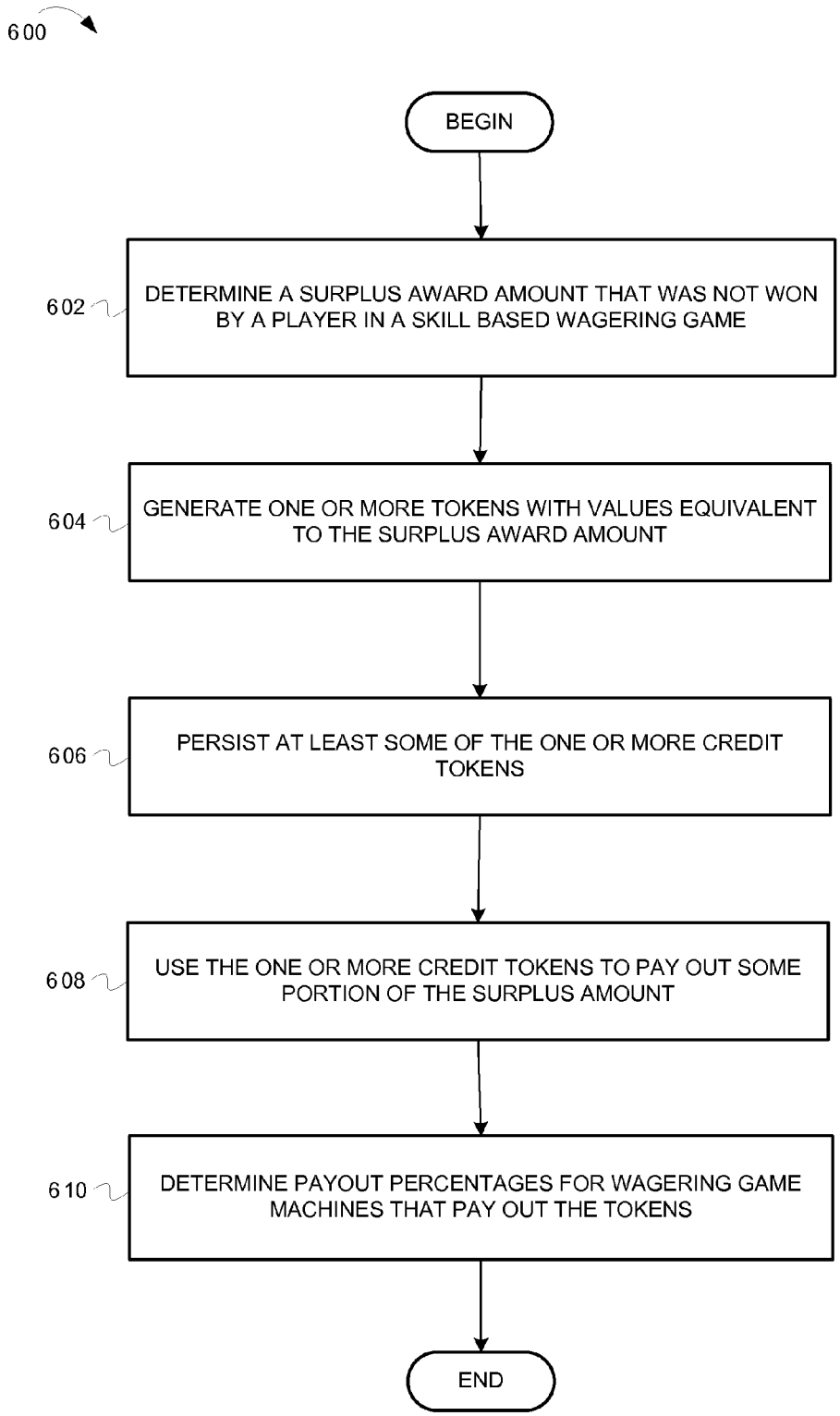
FIG. 6 is a flow diagram 600 illustrating controlling surplus amounts from skill-based wagering games using tokens, according to some embodiments.

In FIG. 1, a player account can win some, or all, of the winnable award amount by playing the skill-based pinball bonus game 110. The skill-based pinball bonus game 110 can reference skill-based game settings 152 stored on the wagering game server 150, that indicate the winnable award amount (e.g., one thousand winnable credits for the skill-based pinball bonus game 110). The skill-based pinball bonus game 110 can include game controller elements (e.g., paddles 111 and ball launcher 114) that a wagering game player can use to physically manipulate one or more wagering game outcome determination elements (e.g., a ball 112). The game controller elements, such as the paddles 111 and the ball launcher 114, are configured to respond directly and immediately to a player's physical manipulation of a game control device (e.g., a button, a keyboard, a joystick, etc.). During the skill-based pinball bonus game 110, the player can manipulate the paddles 111, using physical skill, to accomplish game goals and/or to prevent game penalties. The game penalties can include a method of being penalized by poor skill, such as ball drain 115, which collects the ball 112 and causes the player to lose a turn, or life, if the player does not keep the ball 112 active within the game using the paddles 111. The game goals can be characterized by game goal elements, such as bumpers 113, which, when hit by the ball 112, can provide some portion of the winnable award amount from the allocated source(s). The skill-based pinball bonus game 110 lasts for only a specified duration, such as for a limited time period, or for a certain number of lives (e.g., a set number of balls can be launched using the ball launcher 114). Skilled players can potentially earn the entire winnable award amount if they accomplish all the game goals and avoid the game penalties. Once collecting the entire winnable award amount, the game can end. However, if the player does not win all of the winnable award amount for the skill-based pinball bonus game 110 (e.g., the player loses all of the lives allotted during the game), then the game can end, and the wagering game server 150 can calculate the portion of the winnable award amount that was not won from the allocated source(s) and uses the non-won portion of the winnable award amount as a surplus amount. The wagering game server 150 can reference the skill-based game settings 152 and determine how to distribute the surplus amount during subsequent activities, such as to the wagering game player during subsequent wagering game activity, to unskilled players during subsequent wagering game play, randomly to subsequent users of the wagering game machine 160, to other players on other wagering game machines, etc. For example, the wagering game server 150 can allocate some of the surplus amount to one or more wagering game pools and/or as earnable tokens that persist with the wagering game machine 160. The wagering game machine 160 can present subsequent wagering games, such as a video poker game 120, which may or may not be skill-based, which can award the persisted tokens based on game events. The game events can be pre-defined as triggers in trigger settings 154 stored on the wagering game server 150. FIGS. 4, 5 and 6 below illustrate examples of paying out surplus amounts using wagering pools, tokens, and triggers.

According to some embodiments, the wagering game system 100 can include numerous capabilities and configurations. For example, although FIG. 1 illustrates a specific example of a skilled-based wagering game that responds to physical skill (e.g., hand-eye coordination), the wagering game machine 160 can also present other types of skill-based wagering games, such as games that rely on a player's knowledge, dexterity, strategy, stamina, etc. Those other types of skill-based games can also utilize winnable award amounts, surplus amounts, tokens, triggers, etc.

Although FIG. 1 describes some embodiments, the following sections describe many other features and embodiments.

Example Operating Environments

This section describes example operating environments and networks and presents structural aspects of some embodiments. More specifically, this section includes discussion about wagering game system architectures.

Wagering Game System Architecture

Figure 2:
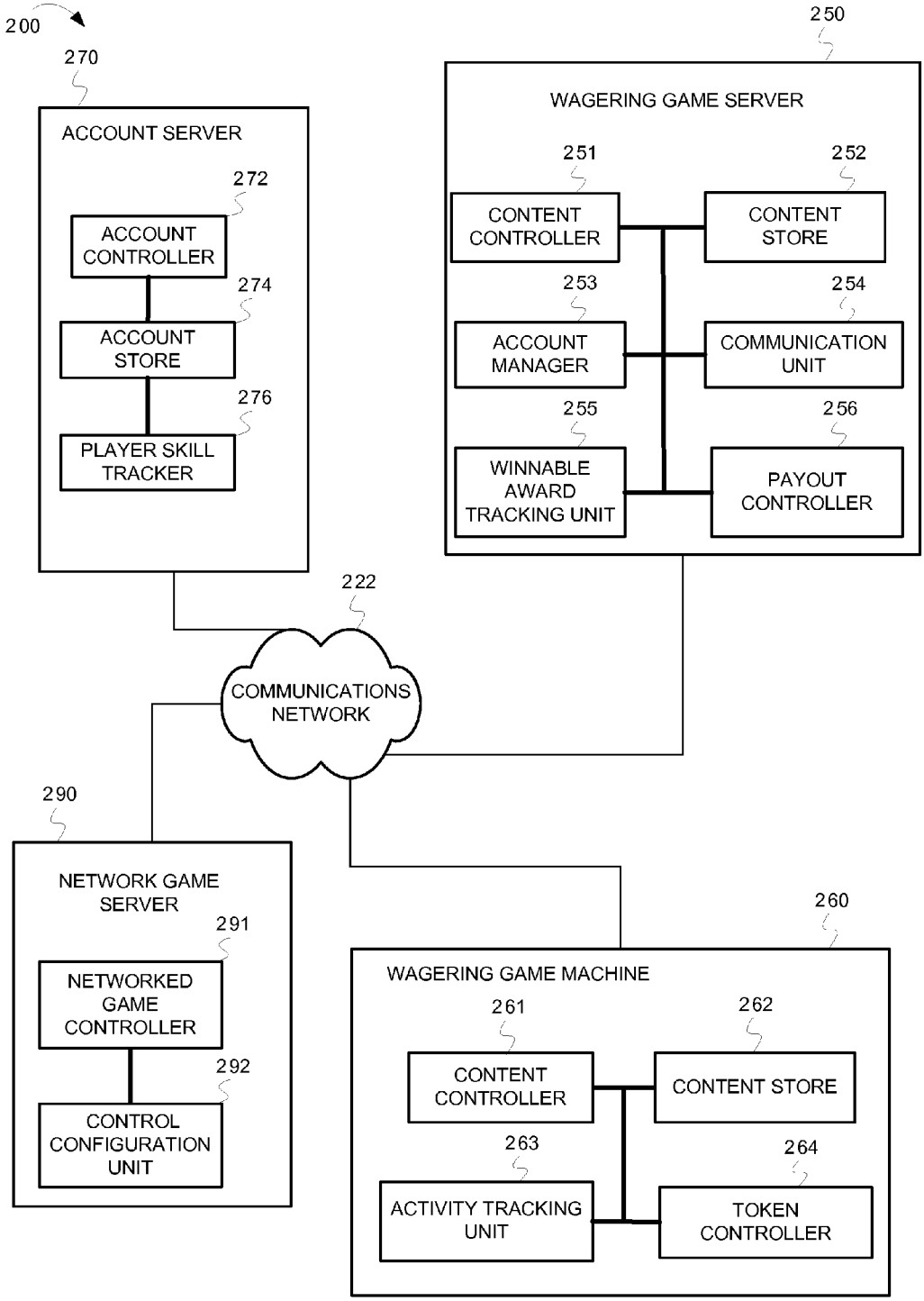
FIG. 2 is an illustration of a wagering game system architecture 200, according to some embodiments.

FIG. 2 is a conceptual diagram that illustrates an example of a wagering game system architecture 200, according to some embodiments. The wagering game system architecture 200 can include an account server 270 configured to control user related accounts accessible via wagering game networks and social networks. The account server 270 can store and track player information, such as identifying information (e.g., avatars, screen name, account identification numbers, etc.) or other information like financial account information, social contact information, etc. The account server 270 can contain accounts for social contacts referenced by the player account. The account server 270 can also provide auditing capabilities, according to regulatory rules, and track the performance of players, machines, and servers. The account server 270 can include an account controller 272 configured to control information for a player's account. The account server 270 can also include an account store 274 configured to store information for a player's account. The account server 270 can also include a player skill tracker 276 configured to track skill points and game modifiers earned.

The wagering game system architecture 200 can also include a wagering game server 250 configured to control wagering game content and communicate wagering game information, account information, and other information to and from a wagering game machine 260. The wagering game server 250 can include a content controller 251 configured to manage and control content for the presentation of content on the wagering game machine 260. For example, the content controller 251 can generate game results (e.g., win/loss values), including win amounts, for games played on the wagering game machine 260. The content controller 251 can communicate the game results to the wagering game machine 260. The content controller 251 can also generate random numbers and provide them to the wagering game machine 260 so that the wagering game machine 260 can generate game results. The wagering game server 250 can also include a content store 252 configured to contain content to present on the wagering game machine 260. The wagering game server 250 can also include an account manager 253 configured to control information related to player accounts. For example, the account manager 253 can communicate wager amounts, game results amounts (e.g., win amounts), bonus game amounts, etc., to the account server 270. The wagering game server 250 can also include a communication unit 254 configured to communicate information to the wagering game machine 260 and to communicate with other systems, devices and networks. The communication unit 254 can also track and communicate with network servers (e.g., the network game server 290), such as to distribute surplus amounts to wagering game pools, jackpots, networked wagering game awards, etc. The wagering game server 250 can also include a winnable award tracking unit 255 configured to determine winnable award amounts during wagering games. The winnable award tracking unit 255 can also distribute and award surplus amounts that were not won during a wagering game session. The wagering game server 250 can also include a payout controller 256 configured to track and determine payouts based on limited award amounts (e.g., winnable awards and awarded surplus awards).

The wagering game system architecture 200 can also include a wagering game machine 260 configured to present wagering games and receive and transmit information to control and present skill-based wagering games. The wagering game machine 260 can include a content controller 261 configured to manage and control content and presentation of content on the wagering game machine 260. The wagering game machine 260 can also include a content store 262 configured to contain content to present on the wagering game machine 260. The wagering game machine 260 can also include an activity tracking unit 263 configured to track accomplishment of skill-based goals in skill-based games. The activity tracking unit 263 can also determine that activity triggers, or wagering game events, have occurred. The activity tracking unit 263 can also award and control skill points and game modifiers. The wagering game machine 260 can also include a token controller 264 configured to track and award tokens.

The wagering game system architecture 200 can also include a network game server 290. The network game server 290 can include a networked game controller 291 that can be configured to receive requests from multiple wagering game players to compete in a networked wagering game. The networked game controller 291 can provide game content to the multiple wagering game players and one or more awards, based on player skill, from a limited award amount, such as a set amount of winnable credits and/or awards limited to a progressive pool. The network game server 290 can also include a control configuration unit 292 configured to detect personal player control devices, determine compatibility with the networked game content, provide game control settings, etc.

Each component shown in the wagering game system architecture 200 is shown as a separate and distinct element connected via a communications network 222. However, some functions performed by one component could be performed by other components. For example, the wagering game server 250 can also be configured to perform functions of the activity tracking unit 263 and/or the token controller 264. Furthermore, the components shown may all be contained in one device, but some, or all, may be included in, or performed by multiple devices, as in the configurations shown in FIG. 2 or other configurations not shown. Furthermore, the wagering game system architecture 200 can be implemented as software, hardware, any combination thereof, or other forms of embodiments not listed. For example, any of the network components (e.g., the wagering game machines, servers, etc.) can include hardware and machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 3:
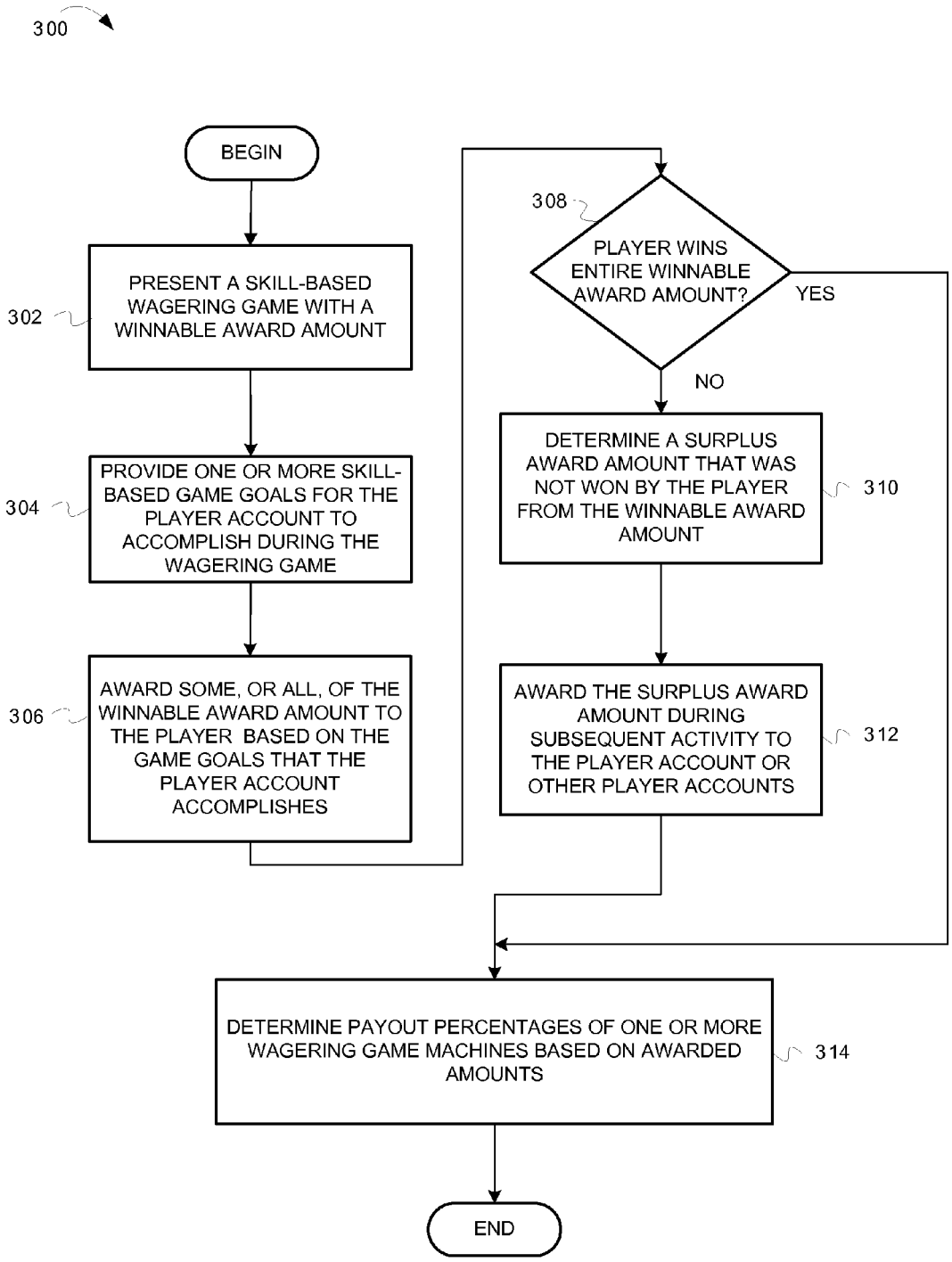
FIG. 3 is a flow diagram 300 illustrating controlling limited award amounts in skill-based wagering games, according to some embodiments.

FIG. 3 is a flow diagram illustrating controlling limited award amounts in skill-based wagering games, according to some embodiments. FIG. 1 helps illustrate the flow of FIG. 3, according to some embodiments. This description will present FIG. 3 in concert with FIG. 1. In FIG. 3, the flow 300 begins at processing block 302, where a wagering game system ("system") presents a skill-based wagering game with a winnable award amount. The skill-based wagering game can be a bonus game, a networked wagering game (e.g., a community wagering game, an online wagering game, etc.), a base wagering game, or any other type of wagering game in which a player can utilize physical skill, strategy, knowledge, dexterity, or other types of abilities to manipulate, organize, select, or in any other way control wagering game play elements to accomplish wagering game outcomes. The skill-based wagering game can have a limited, or pre-arranged, monetary award available for winning during at least some portion of the wagering game. The limited winnable monetary award can be a set, amount of winnable credits that represent a money value ("winnable credit amount"). In other embodiments, the system can offer other allocated amounts that are not monetary, such as entertainment points. In some embodiments, a limited winnable credit amount sets the duration of the skill-based game, because the game can last only as long as there are still credits to be won. Consequently, the skill-based game is limited in duration to restrict the skilled player from continuously winning without limit.

The flow 300 continues at processing block 304, where the system provides one or more skill-based game goals for the player account to accomplish during the wagering game. In some embodiments, the game goals can pay out credits, based, at least in part, on the player's skillful manipulation of the game play elements. In some embodiments, the wagering game can include controllable game play elements that the player can manipulate or control, such as the paddles 111 and the ball launcher 114 in the skill-based pinball bonus game 110 in FIG. 1. The controllable game play elements respond directly and immediately to the player's use of control devices incorporated to and/or attached to the wagering game machine. The control devices generate control signals that correlate directly to the physical movements and actions of the player. The system can process control instructions that control the movement and actions of controllable playing elements (e.g., controller elements) within the wagering game. The controllable playing elements respond immediately, via the player's movements and actions, to accomplish wagering game goals and/or to avoid game penalties. As described in FIG. 1, the player can use the game controller elements (e.g., the paddles 111 and the ball launcher 114), to control the movement of the ball 112 to hit the bumpers 113. The bumpers 113 represent game goals that pay out credits from the winnable credit amount. The player can use the game controller elements to avoid penalties, such as preventing the ball 112 from falling into the ball drain 115. Other games may have other goals and/or penalties, such as shooting games, where the player would instead manipulate a shooting device (e.g., a gun, a laser, a cannon, a water balloon launcher, etc.) as the game controller element to direct projectiles toward one or more targets. The targets would represent the game goals. Some targets may shoot back, representing penalties if the player's character gets hit. The player may lose time, health, lives, etc., tracked on a game duration meter (e.g., lives meter 117), indicating the player's degree of penalties, the duration left in the game, etc. Once the game penalty meter reaches a limit (e.g., once all of the health and/or lives are depleted, once a game time runs out, one a timed bonus multiplier has expired, etc.), the game may end. There are many other examples of games of skill, all of which can be adapted to use in a skill-based wagering game. A limited win amount (e.g., a fixed winnable credit amount) can be associated with each.

The flow 300 continues at processing block 306, where the system awards some, or all, of the winnable award amount to the player based on the game goals that the player account accomplishes. For example, in FIG. 1, the system 100 determines how many times the ball 112 hits the bumpers 113, and determines the win value assigned to the bumpers 113. The system 100 then assigns the win value of the bumpers 113 as credits to the player's account. The credits can increase on the credit meter 119 and also be reported to an account server (e.g., the account server 170 in FIG. 2). Because the wagering game is skilled based and responds directly to a player's physical dexterity, acumen, or other abilities, highly skilled players may be more likely to win more of the winnable credit amount than a less skilled player. Therefore, in some embodiments, the system can be player adaptive, wherein the system can sense the skill level of a player (e.g., based on game results, strategy weaknesses, patterns of successful manipulation of the controllable game play elements, etc.) and provide greater awards (e.g., greater bonuses) if the player is poorly skilled, or lower bonuses if the player is highly skilled. The system can modify the physics of the skill-based wagering game to make the game harder as it determines that the game is too easy for a player, or vice versa, to make the game easier as it determines that the game is too hard for a player. The system can pre-calculate over time what the worst and best players can perform for the game, so that payout tables for the skill-based game can be determined ahead of time. The system can set the limited win amount for the game (e.g., the winnable credit amount) so that a highly skilled player doesn't win more than the limited amount. The system can hold the limited amounts in escrow during the playing session so that it is available to win if the player plays to an optimum level (the highest amount of credits that can be won by playing the game with the highest amount of skill). The system can track and report the game statistics and information to game operators and can provide settings and controls that the operators can use to adjust the limited winnable amount for a game. For example, in FIG. 1, the skill-based game settings 152 can include a control 116 to set the winnable credit amount for the skill-based pinball bonus game 110. The system can also report the game statistics and other information to wagering game manufacturers so that they can adjust the skill level (e.g., to make the game hard enough) so that the game doesn't pay out more than 100% on average.

The flow 300 continues at processing block 308, where the system determines whether the player account earns the entire winnable award amount or less than the winnable award amount. In other words, if, for example, the player account obtains less than optimal play during the skill based game, the player may not earn the entire amount allocated to the limited winnable award amount. Therefore, when the skill-based game, or skill-based portion of the game, ends (e.g., the player incurs sufficient penalties to end the game, the game clock or skill-based portion timer has expired, the player achieves optimal play, etc.), the system can calculate, for example, an amount of earned credits ("earned credit amount") that the player won from the winnable credit amount. If the earned credit amount is less than the winnable credit amount, the flow 300 continues at processing block 310. If, however, the earned credit amount equals the winnable credit amount, the flow continues at processing block 314.

The flow 300 continues at processing block 310, where the system determines a surplus award amount that was not won by the player from the winnable award amount. The surplus amount can be a winnable credit amount minus an amount of won credits.

The flow 300 continues at processing block 312, where the system awards at least some portion of the surplus amount during subsequent activity to the player account or other player accounts. The system eventually pays out the surplus amount in some form or another to a wagering game player account. FIGS. 4, 5, and 6 illustrate examples of how a surplus amount can be awarded including using wagering game pools, triggers, and tokens. In some embodiments, the system can distribute the surplus amount over a bank of games. In some embodiments, the system can award some, or all, of the surplus amount using mystery bonuses payable in lump sums, partial pays, additional feature bonuses, etc. In some embodiments, the system can provide settings that an operator can use to determine how to award some, or all, of the surplus amount. For example, in FIG. 1, the skill-based game settings 152 can include a surplus allocations settings 118 to determine how to distribute the surplus amount (e.g., a specific percentage value to a progressive pool, another percentage value to earnable tokens that persist with the wagering game machine 160, etc.). The system can automatically change the values in the surplus allocation settings 118 based on statistics 130 of payouts, surplus statistics, etc. of the wagering game machine 160. For instance, if the overall payout value for the wagering game machine is high, and doesn't require the surplus to be awarded on the wagering game machine 160 to bring up the overall payout value, then the system 100 can change the surplus allocations settings 118 to distribute some, or all, of the surplus amount to the progressive pool, which can payout the distributed portion of the surplus amount to other wagering game machines used by other players.

The flow 300 continues at processing block 314, where the system determines payout percentages of one or more wagering game machines based on awarded amounts. If the system awards surplus amounts on a wagering game machine, or a bank of wagering game machines, the actual payout for those machines will increase. The system updates, tracks, and reports that information, as needed. For example, in FIG. 1, the wagering game server 150 can track the payouts for the wagering game machine 160, and other wagering game machines within a group and/or casino wide. The wagering game server 150 can use that information (e.g., via the payout controller 256 in FIG. 2) to determine how surpluses can be used (e.g., to distribute surplus amounts, to distribute earnable tokens, etc.) and/or to report that information to a central controller, a regulatory server, or other devices that may request or use that information.

FIG. 4 is a flow diagram illustrating controlling surplus amounts from skill-based wagering games using wagering game pools, according to some embodiments. FIG. 1 is a conceptual diagram that helps illustrate the flow of FIG. 4, according to some embodiments. This description will present FIG. 4 in concert with FIG. 1. In FIG. 4, the flow 400 begins at processing block 402, where a wagering game system ("system") determines a surplus award amount that was not won by a player from a winnable award amount in a skill-based wagering game, similar to processing block 310 in flow 300 described in FIG. 3.

The flow 400 continues at processing block 404, where the system allocates the surplus award amount to one or more wagering game pools ("pools"). In some embodiments, the pools can be progressive jackpots, bank-level progressives, mystery bonuses, etc. The system can generate multiple pools. In some embodiments the system can network the pools, make stand-alone pools, etc. The pools can have a reset value and other characteristics common to progressive pools. In some embodiments, the system can allocate the surplus amount to different types of pools. In some embodiments, the system can display the surplus credits graphically moving into a pool to encourage the player to keep playing.

The flow 400 continues at processing block 406, where the system determines that a wagering game machine that is below a theoretical payout percentage. In some embodiments, the system can determine that a wagering game machine may have the lowest payout percentage amongst a group or bank of wagering game machines. The wagering game machine with the lowest payout percentage may need to increase its payout percentage to meet regulatory and/or casino imposed payout percentages. In some embodiments, the system can consider other factors. For example, as described in FIG. 1, and in more detail in FIG. 6, some surplus amounts may already be allocated to a wagering game machine in the form of persisted tokens. Those tokens may be assigned to the wagering game machine to eventually be awarded. Therefore, although the wagering game machine may have the lowest payout, it may have a sufficient amount of tokens that will eventually bring up the payout percentage. As a result, the system may not select that machine, but instead select another machine whose payout percentage is low and does not have a sufficient number of persisted tokens to bring the payout percentage up to the theoretical payout percentage.

The flow 400 continues at processing block 408, where the system awards at least some portion of the pool to a player account that is using the wagering game machine. A player account can be playing a wagering game that promotes and uses the wagering pool (e.g., a slot machine wagering game with a progressive bonus associated with the slot game). In other embodiments, the system can randomly award the pool, such as using a mystery bonus that may be associated with any game available on the wagering game machine. The system can transfer the awarded surplus amount to the player's account on an account server.

The flow 400 continues at processing block 410, where the system determines the wagering game machine's payout percentage, similar to processing block processing block 314 in FIG. 3.

FIG. 5 is a flow diagram illustrating controlling surplus amounts from skill-based wagering games using triggers, according to some embodiments. FIG. 1 helps illustrate the flow of FIG. 5, according to some embodiments. This description will present FIG. 5 in concert with FIG. 1. In FIG. 5, the flow 500 begins at processing block 502, where a wagering game system ("system") determines a surplus award amount that was not won by a player from a winnable award amount in a skill-based wagering game, similar to processing block 310 in flow 300 described in FIG. 3. The system tracks the surplus amount and holds it in escrow, or some other holding account. The surplus amount can accumulate in that holding account. The system can use any portion of the holding account to pay out a portion of the surplus (or other accumulated surplus values) for a specific wagering game machine, for the same player and/or game session, etc. This is different from allocating the surplus amount to a wagering game pool because the holding account reserves the right to utilize the surplus amount in all, or parts, to reward specific activities based on triggers that occur during a wagering game. For example, if a player does not play optimally during a skill-based game, the system can store the surplus amount that wasn't won and use it to pay out small awards during the base game when triggers occur.

The flow 500 continues at processing block 504, where the system determines player account activity on a wagering game machine. For example, a player account can log on a player account and determine that the player account is using the wagering game machine. The player account can play wagering games or perform some other activity on the wagering game machine.

The flow 500 continues at processing block 506, where the system determines a trigger activity that occurs during player account activity. In some embodiments, the trigger activity can occur based on skillful activities performed by the player account or as random events during the wagering game. For example, the system can looks for triggers on a base game (e.g., a reel combination that is obscure, an average bet value increases to a value higher than normal, a set time period occurs, etc.), then provide greater awards, payouts, etc. based on the trigger, up to, at least, the theoretical payout percentage (e.g., to use some, or all, of the surplus amount). In some embodiments, the triggers can be set on a server. The server can watch for the triggers and reference the settings to determine whether the trigger conditions have been met and determine a payout value. For example, in FIG. 1, the wagering game server 150 includes the trigger settings 154 that the system can utilize to track triggers for specific wagering games. The wagering game machine 160, for instance, may present a video poker game 120 after presenting the skill-based pinball bonus game 110. During the pinball game, the player may have not played optimally (i.e., the full winnable award amount may not have been achieved), thus resulting in a surplus amount. The system 100 watches for one or more specific triggers (e.g., a royal flush) indicated in the trigger settings 154 that may occur during the video poker game 120. The trigger settings 154 may indicate a default amount that the system 100 will pay out when the trigger occurs (e.g., when a player's hand occurs showing a royal flush, the system has indicated that a thousand tokens will be paid out based on that trigger). Returning to FIG. 4, the system can track the payout level for a wagering game machine and suspend the payment of credits or other awards based on triggers if the payout percentage of the wagering game machine is already sufficiently high to meet minimum requirements. For example, the system can track the actual payout for a wagering game machine and compare it to the theoretical payout percentage using relative differences (e.g., negative/positive difference values) to indicate how far below or above the actual payout percentage is compared to the theoretical payout percentage. If the relative difference indicates that the theoretical payout is less than or equal to the actual payout, the system may ignore the trigger and not pay out any portion of the surplus from the holding account. If the relative difference indicates that the actual payout percentage is less than the theoretical payout percentage, then the system can apply the trigger payout amount. The system can also time the triggers to occur. If the system needs to pay out a lot of surplus to a wagering game machine, the system can cause a trigger to occur more frequently. If the system cannot predict a trigger's behavior (e.g., the trigger's behavior and/or frequency of occurrence is random), the system can adjust the trigger payout amount to be higher. The system can also have an adaptive algorithm that uses triggers to cause payouts to be higher and less often, or lower and more often, as payout values, surplus values, etc. change over time. Some examples of triggers may include time periods, average bet values, reel combinations, card hands, numbers of games from reel combinations, etc. In some embodiments, the system can also determine triggers based on non-wagering-game activity (e.g., a player is surfing the web and is the 1,000,000$^{th}$ visitor to a website), or even idle activity (e.g., a player has logged on to a wagering game machine but has been in an idle state for several minutes). Non-wagering game activity and idle activity may, in some embodiments, require that the wagering game machine have credits on it.

The flow 500 continues at processing block 508, where the system presents at least some portion of the surplus amount based on the trigger activity. In some embodiments, the system may allocate only a portion of the surplus to the trigger payout. For example, the system can reference a trigger payout setting (e.g., the trigger settings 154 in FIG. 1) indicating a trigger payout value for the trigger, which may be more or less than the amount of the surplus. If the trigger payout value is more than the surplus, the system can still payout the trigger payout value (e.g., by using additional amounts from the holding account that includes surplus amounts from other wagering game machines and/or from previous wagering game sessions that generated surplus amounts). Alternatively, the system can adjust the trigger payout setting to pay out a lesser amount. In some embodiments, the system can change the trigger payout settings based on the frequency, or probability of occurrence, of the trigger. Triggers that occur more rarely may have higher payout values. The system can track and update trigger payout amounts accordingly. The system can pay out the trigger payout value using mystery bonuses where the player can play an additional game that may or may not be skill-based, to win awards within a short time period. In other examples, the system can pay out the trigger payout value directly without requiring the player to perform additional actions.

The flow 500 continues at processing block 510, where the system determines the wagering game machine's payout percentage, similar to processing block processing block 314 in FIG. 3.

FIG. 6 is a flow diagram illustrating controlling surplus amounts from skill-based wagering games using tokens, according to some embodiments. FIG. 1 is a conceptual diagram that helps illustrate the flow of FIG. 6, according to some embodiments. This description will present FIG. 6 in concert with FIG. 1. In FIG. 6, the flow 600 begins at processing block 602, where a wagering game system ("system") determines a surplus amount that was not won by a player in a skill-based wagering game, similar to processing block 310 in FIG. 3.

The flow 600 continues at processing block 604, where the system generates one or more tokens with values equivalent to the surplus award amount. The tokens represent monetary values, such as credits that were not won from a winnable credit amount. Consequently, "tokens" may be referred to in different contexts as "surplus" tokens, "allocated value" tokens, "credit" tokens, etc. The tokens can receive their values from winnable credit amount surpluses. The system can assign fixed and/or variable values to the tokens. For example, the system may have a default "token denomination value" of ten credits, whereby every 10 credits of surplus credits are stored as a single "10 credit" token. Any remainders (e.g., less than 10), may be stored on the machine until another surplus is generated. Alternatively, the system can create tokens with lesser denomination values (e.g., 1 credit tokens). When enough of the lesser denomination tokens are created to reach the default denomination value, the system can combine the lesser denomination tokens into one default denomination value token. The tokens can be used, subsequently, to pay out the surplus. In some embodiments, the tokens may be earned, using skill-based games, such as by expressing physical skill during physically skill-based bonus rounds, by demonstrating good strategy or expert knowledge in base games, etc. Consequently, in some embodiments, the tokens may be referred to as "earnable" tokens.

The flow 600 continues at processing block 606, where the system persists at least some of the one or more tokens on the wagering game system. For example, the system can persist at least some of the one or more tokes on a wagering game machine on which the surplus award amount was determined or generated. The wagering game machine can provide skill-based games (e.g., bonus rounds and base games), which can be designed to pay out tokens instead of, or in conjunction with, surplus award amounts. The game play allows the player to win the tokens based on the player's skill. Any amount of tokens that the player does not win during the skill-based portion of the wagering game can be persisted on the wagering game machine or elsewhere on a wagering game network (e.g., when wagering game machines networked together). In some embodiments, the system can also assign some of the tokens to other machines, to wagering game pools, as tournament prizes, for use as awards in networked wagering games, or for other activity that can be awarded using a wagering game machine. In some embodiments, the system can display, as graphical symbols (e.g., as coin symbols), the tokens that are generated and stored on a wagering game machine to encourage the player to keep playing the wagering game machine.

The flow 600 continues at processing block 608, where the system uses the one or more tokens to pay out some portion of the surplus award amount. If the tokens are persisted on a wagering game machine, the system can use those tokens to pay out the surplus award amount on that wagering game machine. In some embodiments, the system can modify the duration of the skill-based game based on the number of tokens available to be won. The system can present the tokens as a mystery pay. In some embodiments, the system can pay out the tokens according to triggered activities, as shown in FIG. 1, wherein the video poker game 120 pays out a trigger payout value in credit tokens when a pre-determined card hand occurs.

The flow 600 continues at processing block 610, where the system determines payout percentages for wagering game machines that pay out the tokens, similar to processing block processing block 314 in FIG. 3. The system can calculate the value of the tokens that were awarded and determine that the awarded tokens affect the wagering game machine's payout percentage.

Figure 7:
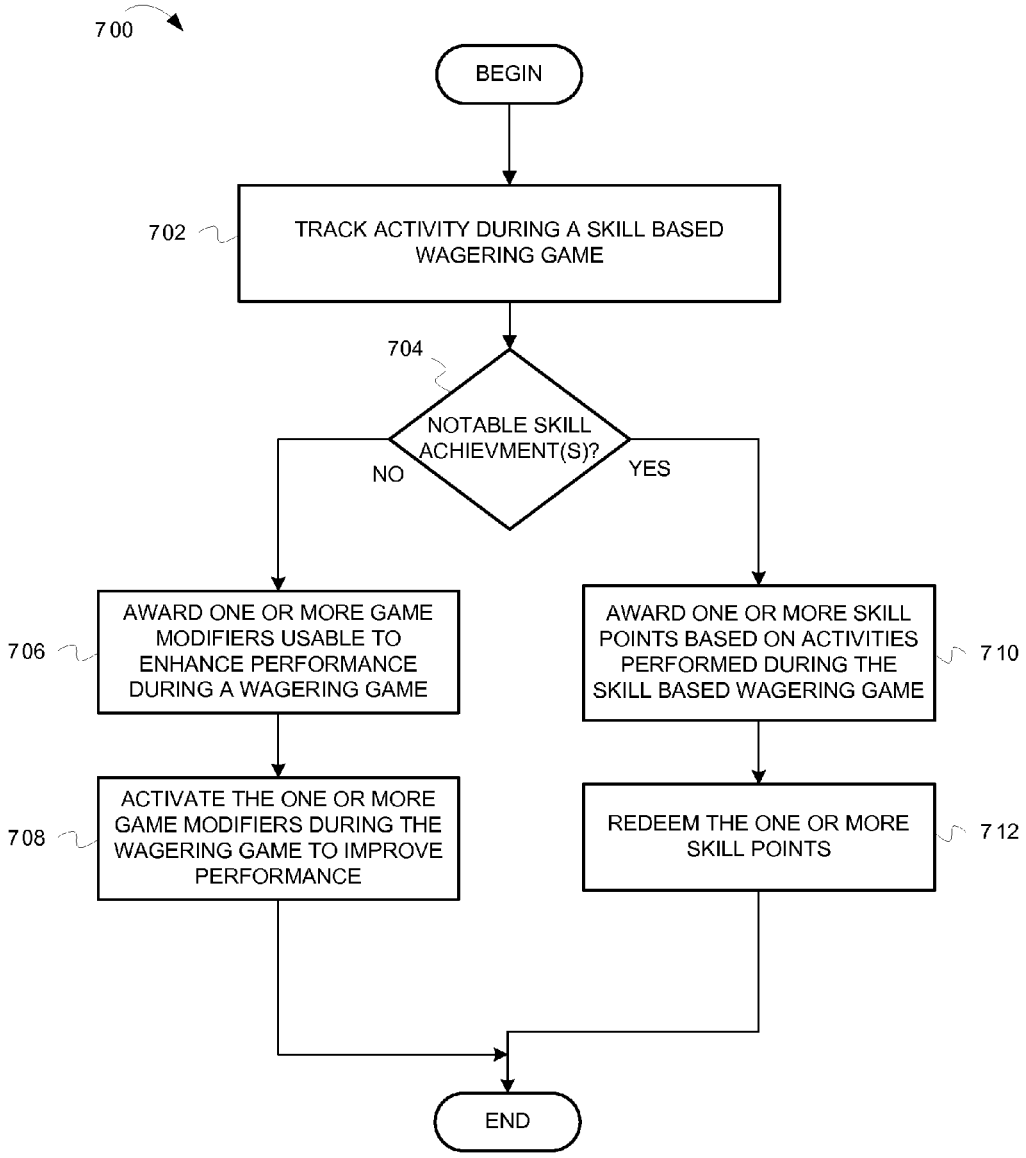
FIG. 7 is a flow diagram 700 illustrating providing skill-based wagering game points and game modifiers, according to some embodiments.
Figure 8:
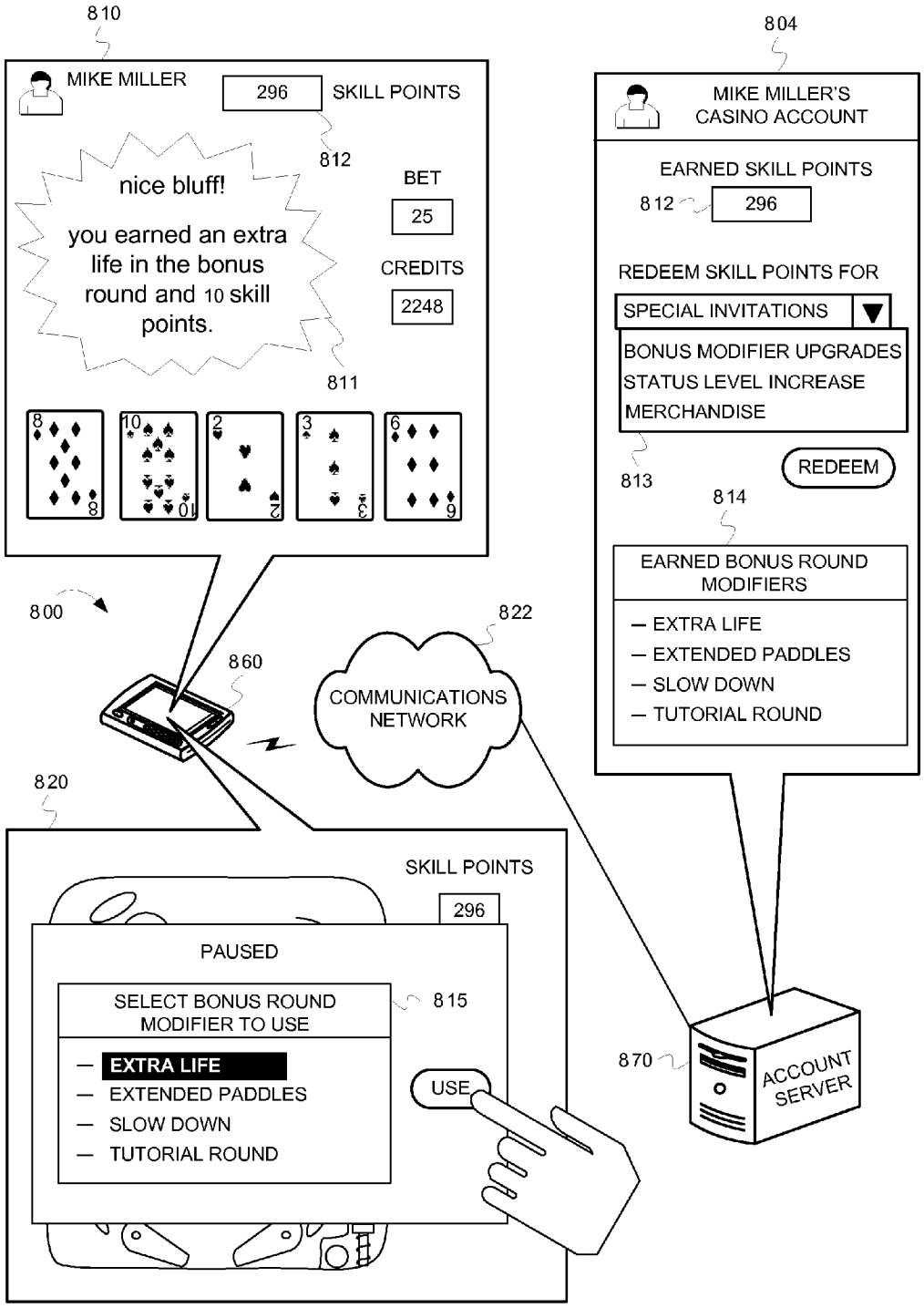
FIG. 8 is an illustration of providing skill-based wagering game points and game modifiers, according to some embodiments.

FIG. 7 is a flow diagram illustrating providing skill-based wagering game points and game modifiers, according to some embodiments. FIG. 8 is a conceptual diagram that helps illustrate the flow of FIG. 7, according to some embodiments. This description will present FIG. 7 in concert with FIG. 8. In FIG. 7, the flow 700 begins at processing block 702, where a wagering game system ("system") tracks activity during a skill-based wagering game. The system gathers activity data on patterns of successful manipulation of the controllable game play elements, game outcomes, exhibited strategy weaknesses and strengths, etc.

The flow 700 continues at processing block 704, where the system determines whether the player account exhibits notable skill proficiency and/or achievement during the skill-based wagering game. The system can determine skill level by a player account by analyzing the activity data to estimate a skill level for the player account. For instance, a player account may lose lives or health very quickly and the system can determine that the player account has a low skill level. In some embodiments, the system may not be able to ascertain a skill level or the system may not attempt to determine skill level (e.g., the processing block may be optional). If the system determines notable skill proficient or achievement, the flow 700 continues at processing block 710 where the system awards skill points. Otherwise, the flow 700 continues at processing block 706.

The flow 700 continues at processing block 706, where the system awards one or more game modifiers usable to enhance performance during a wagering game. In some embodiments, the game modifiers can be related to the current skill-based wagering game, to a subsequent game (e.g., a bonus game), and/or to a competitive networked wagering game. Game modifiers may include, extra abilities of a player's character or decreased abilities of non-player elements, which may include, but are not limited to, increased health values, extra lives, extra power for controllable game elements (e.g., more powerful player controlled characters, double shooters, double-sized paddle or double paddle, smart bombs, etc.), increased speed for controllable game elements (e.g., faster player controller characters, quicker paddles, faster shooting devices, etc.), time suspension or decreased speed for game outcome determination elements and penalty actors (slower movement of a ball, slower bullets from an enemies gun, etc.), tutorials for a game, hints or tips (e.g., a next move in a strategy game, a location of a clue in a mystery game, a partial solution in a puzzle game, etc.), shields and other protectors, enhanced character sizes or functions (e.g., in a fish-tank themed game a game modifier can cause a player's fish character to grow from a fish to a shark, in a racing themed game a game modifier can cause a player's car character to change into a race-car), temporary invincibility or invisibility, warping to safety, etc. The game modifiers can also include value multipliers which may multiply amounts that can be won during the skill-based game. The game modifiers can also include extra units of time, a larger selection of options in a skill-based game of strategy, access to higher level achievements (e.g., the higher levels of a skill-based game can give more credits than lower levels), the ability to skip levels, the ability to access progressive jackpots or large awards for reaching high levels, etc. Upon playing the base game, a player can earn, or receive, one or more units (e.g., icons, graphics, symbols, etc.) representing a skill-based game modifier. The accumulation of such units may occur until a subsequent skill-based game (e.g., a skill-based bonus round) is triggered at which time the accumulated units can affect the condition of the skill-based game. By providing game modifiers, the system can assist players to enhance their skills during the skill-based game, making the skill-based game more fun, while at the same time increasing a players chance to win more of a limited winnable award amount, getting the wagering game machine closer to its theoretical payout percentage. The game modifiers also heighten anticipation for the skill-based game. FIG. 8 illustrates an example of a wagering game system ("system") 800 that awards and controls game modifiers. In FIG. 8, a wagering game machine 860 presents a video poker game 810 as a base game. The wagering game presents an award 811 providing, in part, a game modifier for an upcoming bonus game 820. The system 800 stores the game modifier in a player account 804 stored on an account server 870. The account server 870 and the wagering game machine 860 are connected via a communications network 822. The player account 804 can present the game modifiers in a display 814. Game modifiers that are used in skill-based bonus games may be referred to as "bonus round" modifiers. The display 814 shows a list of bonus round modifiers that the player has been awarded, or otherwise received, for use in a skill-based bonus round game. Game modifiers can also be used in networked wagering games, base games, or any other game, or portion of a game, that is skill-based, as well as in other games that may not be skill-based (e.g., to prolong a non-skill-based bonus game). In some examples, the system can provide the game modifiers to players who have exhibited low levels of physical skill in physically skill-based activities presented in the bonus round game. The system can also provide the game modifiers to players who exhibit non-physical skills (e.g., bluffing to a win in the video poker game 810) as a reward to perform better in a skill-based game. In yet other embodiments, the game modifiers can be used to increase the abilities or numbers of non-player characters or elements or to increase the challenge of a skill-based game for highly skilled players (e.g., an extra oil slick). Consequently, game modifiers can be presented to players of all skill levels. In some embodiments, the game modifiers may be dependent on gambling activities of a player. For example, the system 800 may only award game modifiers if a player wagers a maximum bet amount. In some embodiments, the system 800 can associate game modifiers with a wagering game machine so that the game modifiers persist with the wagering game machine even after a player cashes out and/or when all credits are used up for a wagering game session. In other embodiments, the system 800 can cause the game modifiers to expire if the player does not continue the wagering game session, thus encouraging a player to keep using the wagering game machine until the game modifiers can be used. In some embodiments, the system 800 can award the game modifiers within the skill-based game (e.g., they may be earned while playing a skill-based bonus round for which the game modifiers apply). In some embodiments, the system 800 can assign the game modifier with a value that a player can redeem at will, upon bonus round triggers, upon cash-out, or at other times. In some embodiments, the system 800 can provide game modifiers that can be used to temporarily modify the abilities of a base game.

The flow 700 continues at processing block 708, where the system activates the one or more game modifiers during the wagering game to improve performance. In some embodiments, the system can automatically activate the game modifiers for a specific game and/or provide a selection interface for a player account to select the game modifier. In other embodiments, as shown in FIG. 8, the system 800 can present a selection screen 815 to manually select one or more game modifiers during a skill-based wagering game. In some embodiments, the system 800 can recognize and respond to hot keys, console buttons, joysticks, or other input/out devices to activate and use game modifiers. Players may determine when to use game modifiers based on strategy (e.g., an invincibility modifier may be used at any time, but a player can wait to use a game character faces a host of enemy characters). The system 800 can reward the player account with skill points based on the skillful and/or judicious use of game modifiers.

Returning to FIG. 7, if, at processing block 704, the system determines that the player account has accomplished a notable achievement or performance in a skill-based wagering game, then the flow 700 can continue at processing block 710, where the system can award one or more skill points based on activities performed during the skill-based wagering game. For example, in FIG. 8, the video poker game (which is a strategy skill-based wagering game) and the bonus game 820 (which is a physically skill-based wagering game) can both provide skill points 812 for feats of skill performed in either game. The account server 870 can track the skill points 812 in the player account 804. Skill points may be analogous to top scores in a video game. The wagering game machine 860 can list the top skill point earners for games so that the top earning players receive notoriety. The skill points can give highly-skilled players something to aspire to, especially if a skill-based wagering game isn't balanced to their skill level.

The flow 700 continues at processing block 712, where the system redeems the one or more skill points per player request. For example, in FIG. 8, the player account 804 can provide a list of potential awards 813 for which the player can redeem the skill points 812. In some embodiments, the potential awards 813 can be financial rewards, redeemable for credits, merchandise, etc. In some embodiments, the potential awards 813 can correlate to a status award, such as receiving access to a special room, an invitation to prestigious tournament, a status level, an application to a player club, etc. In some embodiments, the potential awards 813 can include game modifiers which the player can receive to perform better in skill-based wagering games. The system 800 may require the player to register with a player club, a customer appreciation program, a marketing research survey, etc., in order to receive and use points.

Returning to FIG. 7, in some embodiments, the system can provide game modifiers during a wagering game regardless of a player's skill. For example, the system may provide game modifiers as a result of random events, such as a combination of slot reels. Similarly, the system can also provide skill points regardless of a player's actual skill. For example, the system may award skill points for a perceived impression of skill. For instance, the system can provide a game outcome that appears to be based on a player's skill, but that was actually a pre-determined outcome regardless of the skill. The system, however, can award the skill points to complete the illusion that the game outcome was based on skill. Further, in some embodiments, skill points, health points, game modifiers, tokens, triggers, etc., after being awarded, can be transferable, portable, network-storable, and/or cashable. In some embodiments, the skill points, health points, game modifiers, tokens, etc. can be awarded promotionally, and can be utilized in conjunction with loyalty clubs. Further, in some embodiments, skill points, health points, tokens, game modifiers etc. can be persisted on the system (e.g., to a machine, to the network, to a player system, to an account, to a loyalty club, etc.) so that they can be used by a player on a wagering game machine, stored in an account, provided on other wagering game machines, traded between player accounts, redeemed for awards, redeemed for cash value, exchanged for other skill points, health points, tokens, game modifiers, etc.

Figure 9:
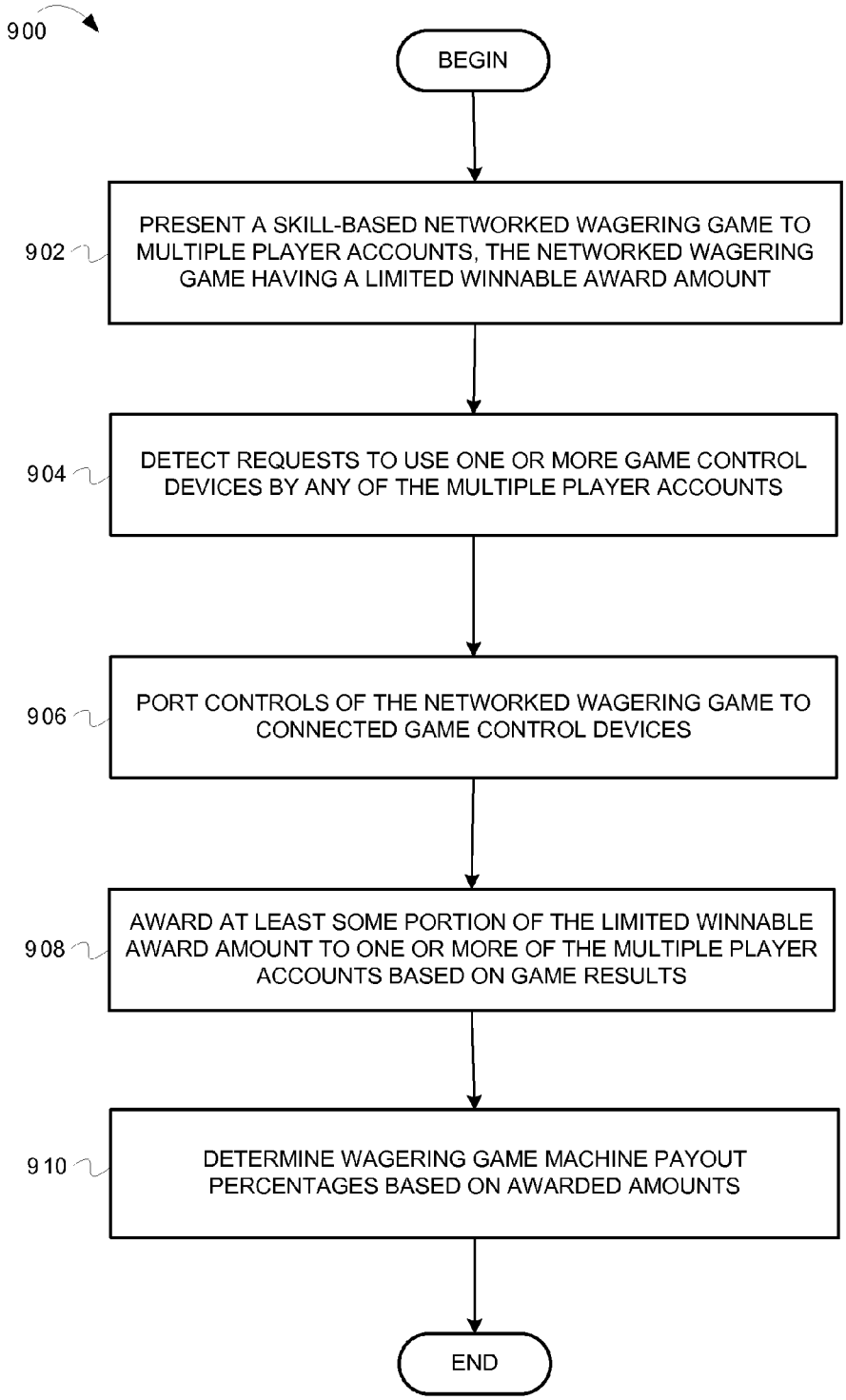
FIG. 9 is a flow diagram 900 illustrating providing skill-based networked wagering games with winnable award amounts, according to some embodiments.
Figure 10:
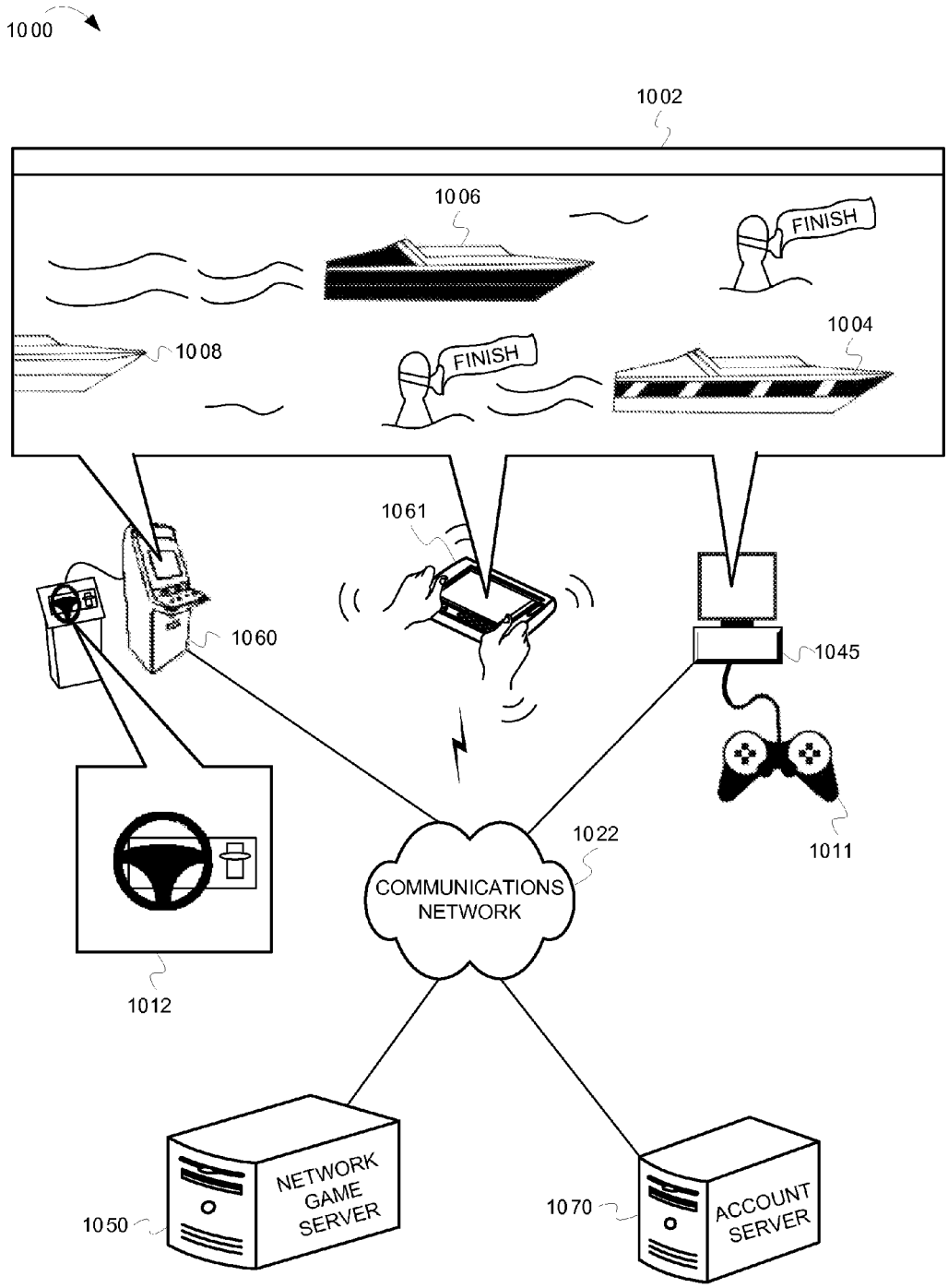
FIG. 10 is an illustration of controlling skill-based networked wagering games, according to some embodiments.

FIG. 9 is a flow diagram illustrating providing skill-based networked wagering games with winnable award amounts, according to some embodiments. FIG. 10 is a conceptual diagram that helps illustrate the flow of FIG. 9, according to some embodiments. This description will present FIG. 9 in concert with FIG. 10. In FIG. 9, the flow 900 begins at processing block 902, where a wagering game system ("system") presents a skill-based networked wagering game to multiple player accounts, the networked wagering game having a limited winnable award amount ("winnable award amount"). In some embodiments, the networked wagering games can include land-based casino community games, online wagering game network games, wide area network games, etc. where one or more player accounts can participate in the networked wagering game via a network connection. The system can require that players who participate in networked wagering games be eligible based on wagering activity. For example, the system can require that players bet in a hand of a networked card game within a certain amount of time from a trigger to be eligible to participate in a networked bonus game. In another example, the system can require that a player play a max bet to be eligible for bonus pools and bonus rounds. In some examples, players with lower bets can still be eligible, but only for a portion of the winnable award amount that correlates to a bet or bet pattern (e.g., can win an amount equal to their lowest best, can win an amount equal to an average bet over a period of time or number of hands, can win an amount equal to their bet divided by the max bet times the winnable award amount, etc.). In some embodiments, networked wagering games can be initiated by one or more players to challenges other players. FIG. 10 illustrates an example of a wagering game system ("system") 1000 that provides a networked wagering game 1002. Players can participate in the networked wagering game 1002 using different player controlled devices, (e.g., a standing model wagering game machine 1060, a mobile wagering game machine 1061, and a personal computer 1045). The player controlled devices 1060, 1061, and 1045 are interconnected via a communications network 1022. Also connected to the communications network 1022 are a network game server 1050 and an account server 1070. The network game server 1050 provides content and control for the networked wagering game 1002. Each of the player controlled devices 1060, 1061 and 1045 participate in the networked wagering game 1002, each controlling a different game play element in the game (e.g., boats 1008, 1006, and 1004) according to physical skill and dexterity in using game controls devices connected to, or part of, the player controlled devices 1060, 1061, and 1045. The account server 1070 can store information about player accounts, including information about skill points and game modifiers which the players can use during the networked wagering game 1002.

The flow 900 continues at processing block 904, where the system detects requests to use one or more game control devices by any of the multiple player accounts. For instance, in FIG. 10, the network game server 1050 can detect when a player account requests to attach, or use an attached, game control device, such as joystick 1011, the steering control device 1012, or other personal devices (e.g., a Wii-mote™, a game pad, a shooting device, a track ball, a dynamic touch pad, a touch screen, etc.). The player can bring their own devices and attach them to wagering game machines via wired or wireless ports (e.g., a device with a blue-tooth communicator so that the player can use their own device instead of having to get one from the casino).

The flow 900 continues at processing block 906, where the system ports controls of the networked wagering game to connected game control devices. In some embodiments, the system 1000 can determine whether the player's attached control device is compatible with the networked wagering game 1002 according to game rules and/or configuration settings. The system 1000 can adapt game control physics and/or payouts to match the device. For example, the networked wagering game 1002 may become more difficult at higher levels and may require a more advanced control device for a player to continue to do well. In other embodiments, however, the system 1000 may determine that a player might have a distinct advantage if using an advanced control device and may make the game harder for the player with the advanced control device. In some embodiments, the mobile wagering game machine 1061 can be used to control wagering games like a Wii-mote controls video games. The way that a player holds the mobile wagering game machine 1061 can navigate a game character or alter a game perspective (e.g., in maze games, a player can physically turn and move the mobile wagering game machine 1061, which, in turn, detects the movement of the player and changes the movement and/or perspective of the player's character).

The flow 900 continues at processing block 908, where the system awards at least some portion of the winnable credit amounts to one or more of the multiple player accounts based on networked wagering game results. Some examples of how the system can award winnable credit amounts for a skill-based networked wagering game may include, but are not limited to the following:

- The system can award more than one player from a winnable award amount, such as the winnable credit amount. For example, in FIG. 10, the system 1000 can award players differing amounts from the winnable award amount based on the order that the boats 1004, 1006, 1008 cross the finish line of the race. The system 1000 can also provide players that place in the race with other awards, such as bonus points, entertainment points, status points, skill points, free spins, merchandise, etc. The system 1000 may hold back some of the winnable award amount unless a player completes other game goals and/or avoids penalties during the race, such as gathering coins along the way, avoiding obstacles, etc. Thus, the system 1000 can still produce a surplus amount if the multiple players do not compete according to optimal play for the different placements. The system 1000 can provide the same game goals and penalties to all players so that all players have an equal chance for optimal play. In other embodiments, however, the system 1000 can provide different goals and penalties to the competing players based on their skill level, status, etc., and/or based on the wagering game machine that they are using (e.g., a wagering game machine that has a low payout may present more coins to gather for a player using that machine for the skill-based networked wagering game). In some embodiments, the system 1000 can also present computerized agents, or non-player characters, to compete against, or penalize, players during game play. As a result, in some embodiments, some network wagering games may result in no winner (e.g., a computerized character wins, no player achieves a minimum goal, etc.). In such scenarios, however, the system 1000 can still provide portions of the winnable award amount to player accounts based on other games goals, such as accomplishments performed during the networked wagering game (e.g., a number of points earned, a number of enemies killed, etc.). If no player meets minimum goals, of if a limited winnable award is not entirely achieved by the players, the system can include the limited winnable award in a surplus amount to payout for subsequent activities.
- The system awards the winnable award amount for a player with a highest hand in a poker game.
- The system awards a portion of the winnable award amount to players in a poker game based on the strength of the hand for a given round or over a number of rounds (e.g., at the end of the tournament). The system can eliminate low ranking hands (e.g., pairs and two pairs) from calculations to ensure that house percentages are acceptable.
- The system awards each eligible player with an option to keep a portion of a winnable award amount or play head-to-head with the network community.
- The system can allocate surplus portions of the winnable award amount to wagering pools or tokens which can be distributed based on triggers from subsequent networked wagering games, subsequent base games, subsequent bonus games, etc.
- The system can set a certain hand or hands randomly picked out of higher possible hands to trigger either immediately or after an amount (possibly random) of hands following the triggering hand.
- The system can encourage players to complete task, events, interactions, etc. in a timely manner by modifying a value of bonus awards, points, scores, or other wagering game achievements based on an amount of time that a player takes to complete the tasks, events, interactions, etc. For example, the system can present a competition game (e.g., a competition bonus game) and indicate to the players that their overall ranking or score (e.g., in the competition), and subsequently, their award, is dependent on their completion time. The system can rank the players with scoring algorithms that factor the players' completion times. In some embodiments, the system, or the players themselves, can select the weight of the completion time factor, based on game type, player history, group agreement, known award values, payout percentages, etc. For example, the system can determine a player's experience level for a game and weight the completion time factor accordingly. In some embodiments, the system may more heavily weight an inexperienced player's time completion factor to encourage the player to complete the game competition more quickly. In other embodiments, however, the system may more heavily weight an experienced player's time completion factor, and less heavily weight an inexperienced player's time completion factor, to give the inexperienced player more of a chance to compete against the more experienced player. The system can indicate overall scores or rankings, as well as indicate the affect that the completion time had on the score, to advertise to players that their time completion skills played a factor in their score.

The flow 900 continues at processing block 910, where the system determines wagering game machine payout percentages based on awarded amounts, similar to processing block processing block 314 in FIG. 3.

Additional Example Embodiments

According to some embodiments, a wagering game system ("system") can provide various example devices, operations, etc., to control and present skill-based wagering games. The following non-exhaustive list enumerates some possible embodiments.

- The system can award surplus amounts by periodically using (e.g., spinning) a set of higher-payout reels in a slot game designed to offset the surplus.
- The system can internally trigger mystery bonuses (e.g., mystery free play) regardless of skill level or in ways that do not favor higher-skilled players.
- The system can apply to conventional skill-based, regulatory-accepted games, such as poker.
- The system can present skill levels for a skill-based wagering game, which a player account can select. The skill factor can increase per level. A payout table can change based on the levels. In some embodiments, the system can automatically change skill levels to adapt to a player's skill level.
- The system can network multiple local games to form larger game audiences and provide larger sources of winnable award amounts.

The system can present one or more a mystery pay symbols over one or more reels on a slot machine game. The symbol(s) can animate signifying a mystery pay win of a surplus amount. The symbol(s) can turn into credit amounts that, optionally, graphically and properly combine with the win and/or the credit amounts for the player account playing the slot game. The symbol(s) can fade or disappear and reveal the reels. For larger awards, surplus payouts can be presented as either multiple symbols (scatters or pay line symbols) which can appear to pay out more than the individual symbols (such as multipliers, etc.). Symbols can represent fixed values (closest to the pay) or variable values (lump sum). Multiple symbols can be used to represent a bonus symbol hierarchy that can appear to pay more when the same symbols line up on a pay line. The preceding bonus distribution may be reverse-mapped; that is, presented in a way that appears as a normal base game win similar to normal base game play. In the case of a "closest value" match, there may be a deficit or surplus amount. In this case, the system can provide an associated operator menu configuration to manually enter this surplus amount at an initial setup process to reconcile amounts before RAM clearing a machine.

The system can present a skill-based bonus craps game. The craps game may include two dice displayed on a main video display with a craps playing field in the background. A player can place all standard craps wagers through a pop up window on the main video display. The two dice in the foreground can be floating. The player can use the main touch screen to rotate the dice around until they are in the position from which they like to throw the dice (they can return to this position on the next throw). The system can include a second input device (e.g., a touch screen or track ball) located in the position where the button panel is normally located. The player can use the second input device to throw the dice. The velocity the dice are thrown in the main video display can be determined by the force the player uses on the input device, thus utilizing a degree of player skill. The dice can fly through the air, bounce and collide with the various game objects. A physics engine can determine all actions. Once the dice come to rest, they display a result and the game will pay out appropriately. An additional aspect of this game can be that at the beginning of each die roll, a "bonus circle" appears on the craps table. The location of this "bonus circle" can change with each new dice throw. If the player is able to land one of (or both of) the dice into this circle, the player can win additional awards, thus presenting additional opportunities to utilize skill. The awards could vary based on the number of dice the player is able to land in the circle. The size and location of the circle could vary with each throw (or have a dependency based on the size of the players wager—e.g., the more the player wagers, the bigger the circle). The awards can have monetary value, or have some other perceived value. A few examples of possible awards/features related to landing the dice in the "bonus circle" may include:

(1) Applying a multiplier to any wins that occur on a throw. For example, one die in the circle applies 1× winnings. Two dice in the circle applies 5× winnings (2) Landing the dice in the circle triggers a secondary bonus round of some type.

(3) A bank of Bonus Circle Craps games could be networked together. An automated tournament could start every 5 minutes where players compete to see who can get the most landings in the circle in those five minutes. The players can be ranked on displayed leader board above the bank of games. Prizes could be awarded based on the outcome of each round.

(4) A bank of Bonus Circle Craps games could be networked together and the system can track the number of successful landings in each of the connected games and present a bank total on display above the bank. Players can collaborate by trying to accumulate as many landings as possible on the bank. If a certain number of landings are reached, then one player on the bank can be chosen randomly and given an award.

(5) Instead of having the "bonus circle" displayed at all times, the system can cause the game to go into a special mode to display the circle.

An additional extension to this game concept includes having an object on the table (like a spike) where if the player can hit it then the dice would break apart. Various things could be contained within the dice that are revealed and/or awarded when they break apart. This could include a game multiplier, a bonus trigger or other object (such as balls) that could ricochet into another game (such as roulette) and then payout.

The system can present a skill-based video roulette game in which the player places wagers and then throws a roulette ball into a spinning roulette wheel. The system can pay the players based on the outcome of where the ball lands. Based on some triggering mechanism (perhaps a mystery random trigger) the player can occasionally be given bonus balls. Bonus balls can have different capabilities and attributes (perhaps even different physical attributes). In some embodiments, the system can cause a regular ball to increase into a bonus ball based on game modifiers. For example, a bonus ball could be larger than a normal ball and when it hits the roulette wheel it can break up into several smaller regular size balls each paying out for the bets that were placed. Other attributes for other balls could be sticky, heavy, light, slick, etc., where each type of ball could payout differently.

The system can present other skill-based games where a game player has a pair of virtual dice and throws the dice onto a craps table or roulette table. One die features multipliers on it (multiplying the bonus winnings). The other die has several metal balls in it and can break open when it hits the back of the craps or roulette table. On the craps or roulette table there can be two areas, a triangle shaped area (not limited to a triangle) that features indentations for the balls to drop into that feature credit amounts, and a craps or roulette table that the ball will drop into that features credit or multiplier amounts. If a ball lands in an indentation, the ball drops into the indentation landing in a pachinko slot associated with a high credit amount. A roulette wheel can also have indentations where, once the wheel slows down and stops, a ball could fall into a pachinko area with outcomes that pay out form a winnable credit amount and/or that pay out from a progressive pool or tokens. The dice controller can be a physical track ball type control, a touch and drag input on a screen, etc.

The system can present a wall which a player has to chip away (e.g., within a set time period) to reveal a payout or a bonus round. The system can use a destruction type physics engine to destroy the wall in a spectacular fashion using real-time destruction to destroy and deform the game model to reveal the pay out, bonus game, etc.

The system can present skill-based wagering games that utilize strategy. Strategy skill-based games can include some game goals that differ based on a strategy, thus affecting possible optimal play. For example, in a given hand of poker or black-jack, strategy can change throughout the hand depending on cards that are delivered. Specifically, for instance, the odds of winning a hand change based on the cards that are delivered. Consequently, different strategies of betting, folding, holding, hitting, etc. can change based on the circumstances. Further, some strategies may provide long-term results that may result in the highest winnings over a period of hands (e.g., conservative play may produce more overall winnings than aggressive play, in some situations, as it may allow a player to play more hands). Therefore the system may need to consider various factors when determining optimal play, and consequently, dynamically adapt for strategy games. For instance, the system can dynamically adapt to those various factors and update the winnable amounts, generate and award surplus amounts, generate tokens, provide game modifiers, etc. based on those various factors. In some embodiments, such as for draw poker, optimal play may be more feasibly pre-calculated when the payouts are from fixed award sources (e.g., a fixed award amount) and may exclude payouts from changing award sources, such as from accumulating pools. Further, to make a calculation of what amount of a limited award amount should be offered at any given point in a hand of poker, the system can calculate optimal play after any of the limited award amount has changed. Strategy skill-based wagering games can also payout surplus award amounts using triggers (as illustrated in FIG. 8).

The system can present health points that can be awarded during skill-based games, as game modifiers in previous games, as awards, etc. The health points can also trigger when a bonus game begins (e.g., a bonus round may begin when a certain amount of health points are accumulated during a base game). The bonus points can be affected during a skill-based wagering game as a player character encounters obstacles and/or penalties within the skill-based wagering game. During the skill-based wagering game, the health points can change as a result of the player's action, opponents' actions, etc. Health points can determine durations of skill-based wagering games, bonus games, or other games available on a wagering game network. For instance, a game can end when health points are depleted for a player character, an opponent character, etc. During the game, health points can increase by completing game goals. Health points can be awarded based on skillful play, based on triggered events, and/or randomly.

The system present head-to-head, skill-based competition challenges where players can compete against each other head-to-head. In some embodiments, the system can present competition games where more than one player can compete against another player, where players or teams remains in bonus round or consecutive bonus rounds until defeated (e.g., king of the hill). In some embodiments, the system can present team skill-based games where teams of players can compete against other teams of players. Players of such games can win awards from limited winnable award amounts as rewards for defeating other players, teams, computerized agents, etc. Further, the system can present competitions where a winning player may get a free entry fee into a next round of a bonus round.

The system can present controls for player accounts to redeem skill points for game modifiers. Some game modifiers can have different values and can be redeemed for different amounts of skill points. Game modifiers can also be purchased using other items of value, including credits, money, status points, etc. The system can also cash-out, trade, or otherwise redeem game modifiers and skill points if unused or saved.

The system can provide controls and options to pay for a skill-based game to continue (e.g., buy a continuation with credits, skill points, etc.).

The system can receive and process wagers based on condition within skill-based games (e.g., side-bets).

The system can adjust limited winnable award amounts based on conditions that occur within a skill-based game or in account activity that leads up to a skill-based game. For example, the system can determine that a player account performs a special activity and therefore increases the limited amount of the winnable award accordingly, thus providing the opportunity for the player account to earn more credits during the skill-based game.

Additional Example Operating Environments

This section describes example operating environments, systems and networks, and presents structural aspects of some embodiments.

Wagering Game Machine Architecture

Figure 11:
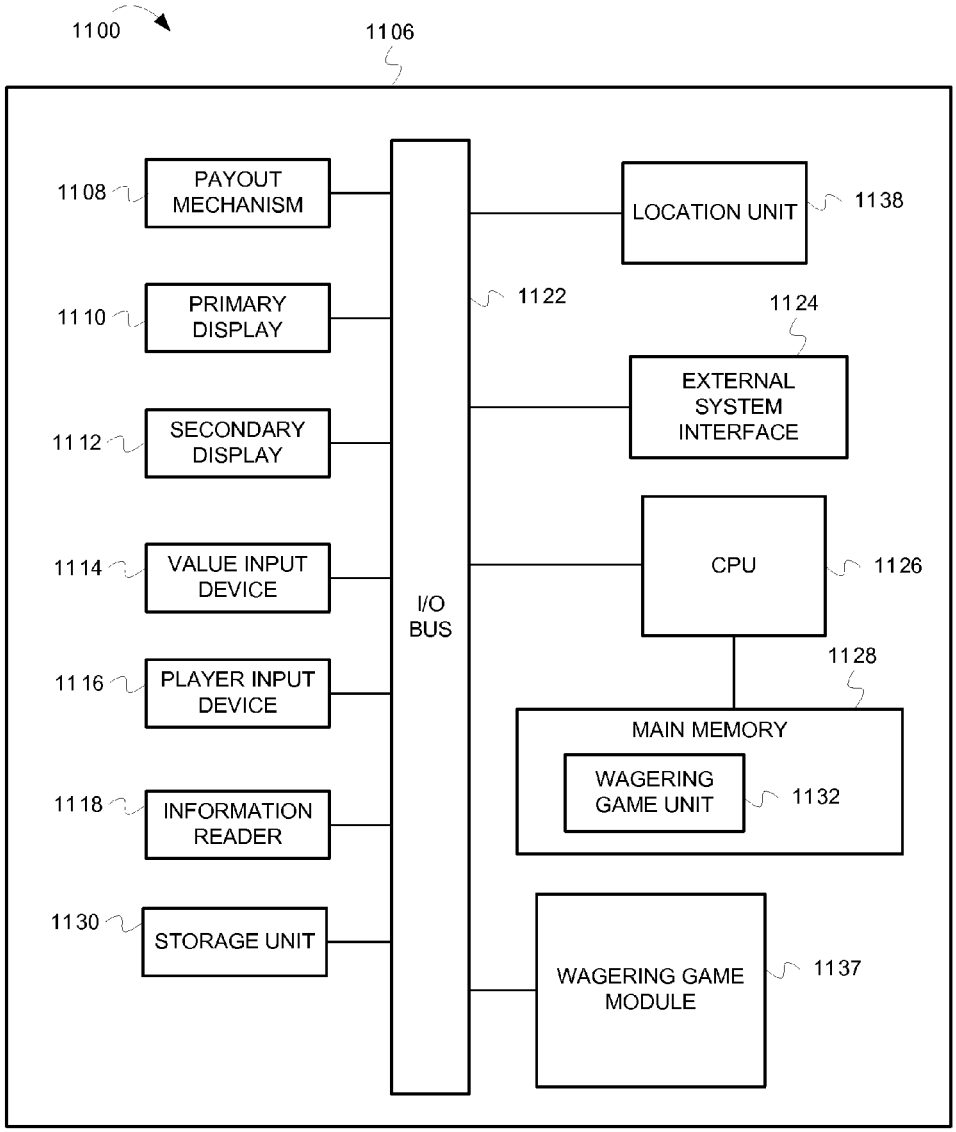
FIG. 11 is an illustration of a wagering game machine architecture 1100, according to some embodiments.

FIG. 11 is a conceptual diagram that illustrates an example of a wagering game machine architecture 1100, according to some embodiments. In FIG. 11, the wagering game machine architecture 1100 includes a wagering game machine 1106, which includes a central processing unit (CPU) 1126 connected to main memory 1128. The CPU 1126 can include any suitable processor, such as an Intel® Pentium processor, Intel® Core 2 Duo processor, AMD Opteron™ processor, or UltraSPARC processor. The main memory 1128 includes a wagering game unit 1132. In some embodiments, the wagering game unit 1132 can present wagering games, such as video poker, video black jack, video slots, video lottery, reel slots, etc., in whole or part.

The CPU 1126 is also connected to an input/output ("I/O") bus 1122, which can include any suitable bus technologies, such as an AGTL+frontside bus and a PCI backside bus. The I/O bus 1122 is connected to a payout mechanism 1108, primary display 1110, secondary display 1112, value input device 1114, player input device 1116, information reader 1118, and storage unit 1130. The player input device 1116 can include the value input device 1114 to the extent the player input device 1116 is used to place wagers. The I/O bus 1122 is also connected to an external system interface 1124, which is connected to external systems (e.g., wagering game networks). The external system interface 1124 can include logic for exchanging information over wired and wireless networks (e.g., 802.11g transceiver, Bluetooth transceiver, Ethernet transceiver, etc.)

The I/O bus 1122 is also connected to a location unit 1138. The location unit 1138 can create player information that indicates the wagering game machine's location/movements in a casino. In some embodiments, the location unit 1138 includes a global positioning system (GPS) receiver that can determine the wagering game machine's location using GPS satellites. In other embodiments, the location unit 1138 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 11, in some embodiments, the location unit 1138 is not connected to the I/O bus 1122.

In some embodiments, the wagering game machine 1106 can include additional peripheral devices and/or more than one of each component shown in FIG. 11. For example, in some embodiments, the wagering game machine 1106 can include multiple external system interfaces 1124 and/or multiple CPUs 1126. In some embodiments, any of the components can be integrated or subdivided.

In some embodiments, the wagering game machine 1106 includes a wagering game module 1137. The wagering game module 1137 can process communications, commands, or other information, where the processing can control and present skill-based wagering games.

Furthermore, any component of the wagering game machine 1106 can include hardware, firmware, and/or machine-readable media including instructions for performing the operations described herein.

Mobile Wagering Game Machine

Figure 12:
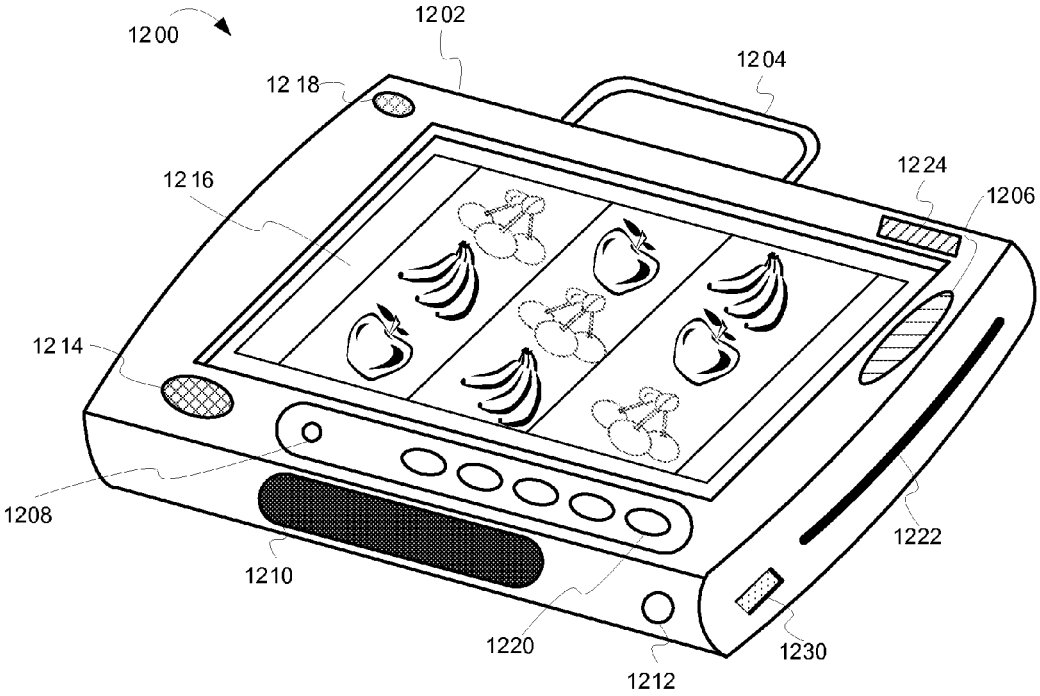
FIG. 12 is an illustration of a mobile wagering game machine 1200, according to some embodiments.

FIG. 12 is a conceptual diagram that illustrates an example of a mobile wagering game machine 1200, according to some embodiments. In FIG. 12, the mobile wagering game machine 1200 includes a housing 1202 for containing internal hardware and/or software such as that described above vis-à-vis FIG. 11. In some embodiments, the housing has a form factor similar to a tablet PC, while other embodiments have different form factors. For example, the mobile wagering game machine 1200 can exhibit smaller form factors, similar to those associated with personal digital assistants. In some embodiments, a handle 1204 is attached to the housing 1202. Additionally, the housing can store a foldout stand 1210, which can hold the mobile wagering game machine 1200 upright or semi-upright on a table or other flat surface.

The mobile wagering game machine 1200 includes several input/output devices. In particular, the mobile wagering game machine 1200 includes buttons 1220, audio jack 1208, speaker 1214, display 1216, biometric device 1206, wireless transmission devices (e.g., wireless communication units 1212 and 1224), microphone 1218, and card reader 1222. Additionally, the mobile wagering game machine can include tilt, orientation, ambient light, or other environmental sensors.

In some embodiments, the mobile wagering game machine 1200 uses the biometric device 1206 for authenticating players, whereas it uses the display 1216 and speakers 1214 for presenting wagering game results and other information (e.g., credits, progressive jackpots, etc.). The mobile wagering game machine 1200 can also present audio through the audio jack 1208 or through a wireless link such as Bluetooth.

In some embodiments, the wireless communication unit 1212 can include infrared wireless communications technology for receiving wagering game content while docked in a wager gaming station. The wireless communication unit 1224 can include an 802.11G transceiver for connecting to and exchanging information with wireless access points. The wireless communication unit 1224 can include a Bluetooth transceiver for exchanging information with other Bluetooth enabled devices.

In some embodiments, the mobile wagering game machine 1200 is constructed from damage resistant materials, such as polymer plastics. Portions of the mobile wagering game machine 1200 can be constructed from non-porous plastics which exhibit antimicrobial qualities. Also, the mobile wagering game machine 1200 can be liquid resistant for easy cleaning and sanitization.

In some embodiments, the mobile wagering game machine 1200 can also include an input/output ("I/O") port 1230 for connecting directly to another device, such as to a peripheral device, a secondary mobile machine, etc. Furthermore, any component of the mobile wagering game machine 1200 can include hardware, firmware, and/or machine-readable media including instructions for performing the operations described herein.

The described embodiments may be provided as a computer program product, or software, that may include a machine-readable medium having stored thereon instructions, which may be used to program a computer system (or other electronic device(s)) to perform a process according to embodiments(s), whether presently described or not, because every conceivable variation is not enumerated herein. A machine readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. In addition, embodiments may be embodied in an electrical, optical, acoustical or other form of propagated signal (e.g., carrier waves, infrared signals, digital signals, etc.), or wireline, wireless, or other communications medium.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A computer-implemented method comprising:

allocating, by one or more processors, money to be used exclusively for monetary payouts on a wagering game network, wherein a first portion of the money can be won based on skillful player input during a skill-based game associated with a wagering game presented on a wagering game machine during a wagering game session, and wherein the allocating guarantees that a surplus amount will be paid out either during the wagering game session or during a later wagering game session, wherein the surplus amount is a remaining portion of the money not won via playing the skill-based game;

providing data for conducting the skill-based game on the wagering game machine;

providing a skilled game goal to accomplish via the skillful player input during the skill-based game;

determining a goal completion amount for accomplishing the skilled game goal;

awarding the goal completion amount;

calculating the surplus amount by subtracting the goal completion amount from the money to be used exclusively for monetary payouts on a wagering game network;

determining that a real payout percentage of the wagering game machine is below a theoretical payout percentage; and after determining that the real payout percentage is below the theoretical payout percentage, awarding the surplus amount to the wagering game machine to increase the real payout percentage to comply with the theoretical payout percentage.

2. The computer-implemented method of claim 1 further comprising:

receiving control signals via skillful manipulation of one or more control devices on the wagering game machine via the skillful player input;

processing control instructions in direct response to the control signals, the control instructions causing one or more control elements to immediately interact with game play elements;

determining that the interaction of the one or more control elements with the game play elements accomplishes the skilled game goal.

3. The computer-implemented method of claim 1, wherein the surplus amount is awarded by randomly presenting one or more of a mystery bonus, a lump sum award, a partial pay award, and an additional feature bonus.

4. The computer-implemented method of claim 1 further comprising:

determining a skill level based on the skillful player input; and adapting a difficulty of the skilled game goal based on the skill level.

5. One or more non-transitory machine-readable storage media having instructions stored thereon, which when executed by a set of one or more processors causes the set of one or more processors to perform operations comprising:

presenting a skill-based game on a wagering game machine in association with a wagering game, wherein a first amount can be won during the skill-based game for skillful performance during the skill-based game;

determining a surplus amount that is not won in the skill-based game via the skillful performance, wherein the surplus amount and first amount are taken from a monetary amount;

determining that an actual payout percentage of the wagering game machine is below a theoretical payout percentage;

processing subsequent gaming activity on the wagering game machine after the skill-based game;

determining a trigger activity that occurs during the subsequent gaming activity; and awarding at least a portion of the surplus amount in response to the trigger activity and in response to the determining that the actual payout percentage of the wagering game machine is below the theoretical payout percentage.

6. The one or more machine-readable storage media of claim 5, wherein awarding the surplus amount increases the actual payout percentage to be equivalent to the theoretical payout percentage.

7. The one or more machine-readable storage media of claim 5, wherein said operations of determining the trigger activity and awarding the at least a portion of the surplus amount includes operations further comprising:

determining one or more trigger settings that describe the trigger activity and one or more trigger payout values associated with the trigger activity;

determining that the trigger activity occurs during the subsequent activity; and paying out the at least some portion of the surplus amount, wherein the surplus of the limited amount corresponds in value to the one or more trigger payout values.

8. The one or more machine-readable storage media of claim 5, said operations further comprising:

generating tokens with value equivalent to the surplus amount;

persisting on the wagering game machine as graphical representations of the surplus amount; and using the tokens to pay the surplus amount.

9. A system, comprising:

a wagering game machine comprising an activity tracking unit configured to track accomplishments of skill-based goals in a skill-based networked game in association with a wagering game, the skill-based networked game having a limited amount of money used exclusively for guaranteed monetary payouts, wherein at least some portion of a limited amount of money can be awarded during the skill-based networked game, and award monetary amounts, from the limited amount of money, based on skill-based goals achieved via player input during the skill-based networked game; and a wagering game server comprising a winnable award tracking unit configured to determine an unearned portion of the limited amount of money for the skill-based networked game, determine that one or more of the wagering game machine and additional wagering game machines have payout percentages that are below a required theoretical payout percentage, and distribute the unearned portion of the limited amount of money to the one or more of the wagering game machine and the additional wagering game machines whose payout percentages are below the required theoretical payout percentage.

10. The system of claim 9, wherein the wagering game machine further comprises a token controller configured to generate, display and award one or more persisted tokens on the wagering game machine, wherein the one or more persisted tokens represent the unearned portion of the limited amount of money as graphical symbols.

11. The system of claim 9, wherein the skill-based networked game is available on a network where one or more of the player accounts can participate in the skill-based networked game via a network connection.

12. The system of claim 9, wherein the activity tracking unit is configured to determine a completion time by a player to complete one or more of the skill-based goals in the skill-based networked game; and adjust at least some portion of a completion score based on the completion time.

13. The system of claim 9 further comprising:

a network game server including a networked game controller configured to receive a request from the wagering game machine and one or more client devices to compete in the skill-based networked wagering game, and provide networked wagering game content to the wagering game machine and one or more client devices, and a control configuration unit configured to detect a personal player control device attached to one or more of the wagering game machine and the one or more client devices, determine compatibility with the networked wagering game content, and provide game control settings.

14. The system of claim 9 further comprising:

an account server including an account controller configured to control information for the player account, an account store configured to store information for the player account, and a player skill tracker configured to track one or more of skill points and game modifiers received during the skill-based networked wagering game.

15. An apparatus comprising:

a wagering game module configured to present a skill-based game on a wagering game machine in association with a wagering game played during a wagering game session, the skill-based game having an amount of money allocated from one or more award sources, wherein any portion of the amount of money can be won during the skill-based game via skillful player input, determine a surplus of the amount of money that was not won from the amount of money via the skillful player input in the skill-based game, generate one or more graphical tokens with values equivalent to the surplus of the amount of money, wherein the one or more tokens are a graphical representation of the surplus of the amount of money, persist at least some of the one or more graphical tokens on a wagering game machine, so that the one or more graphical tokens maintain a persistent association with the wagering game machine beyond the wagering game session, and use the one or more graphical tokens to represent a pay out of some portion of the surplus of the amount of money on the wagering game machine;

determining that a real payout percentage of the wagering game machine is below a theoretical payout percentage; and awarding all the surplus of the amount of money during the wagering game session to increase the real payout percentage to be equal to the theoretical payout percentage.

16. The apparatus of claim 15, wherein the wagering game module is further configured to assign at least some of the one or more tokens to one or more of wagering game pools, tournament prize pools, and awards in networked wagering games.

17. The apparatus of claim 15, wherein the wagering game module is further configured to pay out the some of the portion of the surplus of the amount of money on the wagering game machine according to triggered activities.

18. An apparatus comprising:

means for presenting a wagering game on a wagering game machine;

means for tracking wagering game activity during the wagering game;

means for awarding one or more game modifiers, based on the wagering game activity in the wagering game, the one or more game modifiers configured to enhance performance of skillful player input during a skill-based game associated with the wagering game, the skill-based game configured to respond to a player's skillful manipulation of one or more controllable game elements, and the skill-based game having an allocated amount of money that can be won during at least some portion of the skill-based game via the skillful player input;

means for activating the one or more game modifiers during the skill-based game in response to additional player input during the skill-based game to enhance the performance of the skillful player input; and means for awarding a higher percentage of the allocated amount of money in response to activating the one or more game modifiers during the skill-based game to enhance the performance of the skillful player input, wherein the higher percentage of the allocated amount of money brings an actual payout percentage for the wagering game up to a theoretical payout percentage for the wagering game.

19. The apparatus of claim 18, wherein the means for tracking the wagering game activity comprises:

means for determining a skill level for the player; and means for awarding the one or more game modifiers based on the skill level.

20. The apparatus of claim 18, wherein the means for determining the skill level comprises analyzing past game results for the skill-based game.

21. The apparatus of claim 18 further comprising:

means for presenting a selection interface for the player to select one of the one or more game modifiers.

22. The apparatus of claim 18 further comprising:

means for awarding one or more skill points based on activities performed during any one or more of the wagering game and the skill-based game.

23. The apparatus of claim 22 further comprising:

means for redeeming the one or more skill points.

* * * * *